US006128811A

United States Patent [19]

Panzer et al.

[11] Patent Number: 6,128,811

[45] Date of Patent: Oct. 10, 2000

[54] APPARATUS AND METHOD FOR FORMING TABLE APRONS

[75] Inventors: James D. Panzer, Appleton; Daniel R. Lindgren, DePere, both of Wis.

[73] Assignee: Krueger International, Inc, Green Bay, Wis.

[21] Appl. No.: 09/116,022

[22] Filed: Jul. 15, 1998

[51] Int. Cl.[7] ..... B21B 15/00

[52] U.S. Cl. ..... 29/33 R; 29/34 R; 29/33 K; 29/243; 29/519; 29/564.2; 72/306; 24/20 R

[58] Field of Search ..... 29/34 R, 33 R, 29/33 K, 243, 519, 564.2; 72/306, 319, 323; 24/20 R

[56] References Cited

U.S. PATENT DOCUMENTS

| | | | |
|---|---|---|---|
| 493,390 | 3/1893 | Stirling . | |
| 960,910 | 7/1910 | Hazen . | |
| 986,654 | 3/1911 | Tattu . | |
| 1,682,149 | 8/1928 | Robertson . | |
| 1,761,798 | 6/1930 | Potter . | |
| 3,393,543 | 7/1968 | Gelder . | |
| 3,606,786 | 9/1971 | Taylor . | |
| 3,795,128 | 3/1974 | Benton . | |
| 3,803,893 | 4/1974 | Peddinghaus et al. . | |
| 3,854,248 | 12/1974 | Dayus | 49/465 |
| 4,270,688 | 6/1981 | Janssens et al. | 228/5.1 |
| 4,590,779 | 5/1986 | Stange et al. . | |
| 4,798,073 | 1/1989 | Dischler . | |
| 4,805,436 | 2/1989 | Saegusa . | |
| 4,885,926 | 12/1989 | Lisec . | |
| 4,890,469 | 1/1990 | Dischler . | |
| 4,909,059 | 3/1990 | King . | |
| 5,099,669 | 3/1992 | Del Fabro . | |
| 5,111,555 | 5/1992 | Oetiker | 24/20 R |
| 5,182,932 | 2/1993 | Ritter et al. . | |
| 5,195,348 | 3/1993 | Del Fabro et al. . | |
| 5,228,322 | 7/1993 | Del Fabro et al. . | |
| 5,598,736 | 2/1997 | Erskine . | |

*Primary Examiner*—P. W. Echols
*Assistant Examiner*—John C. Hong
*Attorney, Agent, or Firm*—Andrus, Sceales, Starke & Sawall

[57] ABSTRACT

An apron forming apparatus and method for bending and joining the ends of a pair of apron half segments includes a series of four apron support surfaces lying in a common plane. A clamping arrangement is mounted on each of the apron support surfaces for selectively clamping an apron half segment. A bending arrangement is secured to each of the apron support surfaces for selectively bending an apron half segment. Each of the apron half segments is disposed between a clamping arrangement and a bending arrangement on a pair of apron support surfaces such that the apron half segments lie substantially parallel to each other. Each of the bending arrangements is movable into engagement with an apron half segment to bend the apron half segment such that the ends of one bent apron half segment are placed in overlapping relationship with the ends of the other bent apron half segment. A fastening arrangement is provided for joining the overlapped ends of the bent apron half segments while the apron half segments are positioned on the apron support surfaces. A mechanism is supplied for moving the clamping arrangement and bending arrangement on certain of the apron support surfaces along a first axis substantially parallel to the longitudinal axis of the framework and a second axis substantially perpendicular to the first axis so as to provide variously sized aprons.

40 Claims, 13 Drawing Sheets

FIG. 5
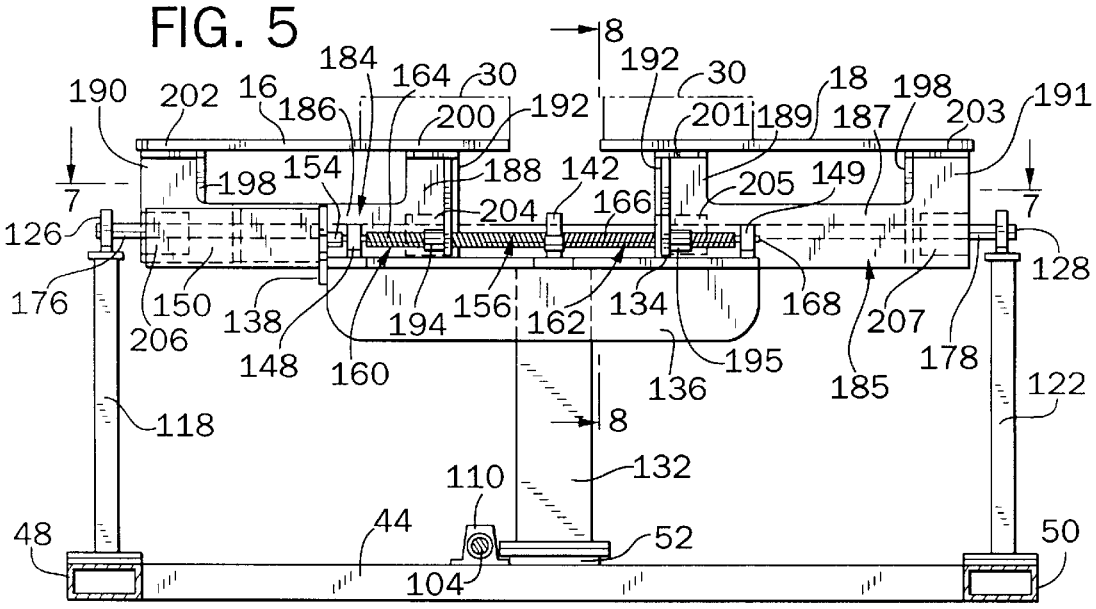
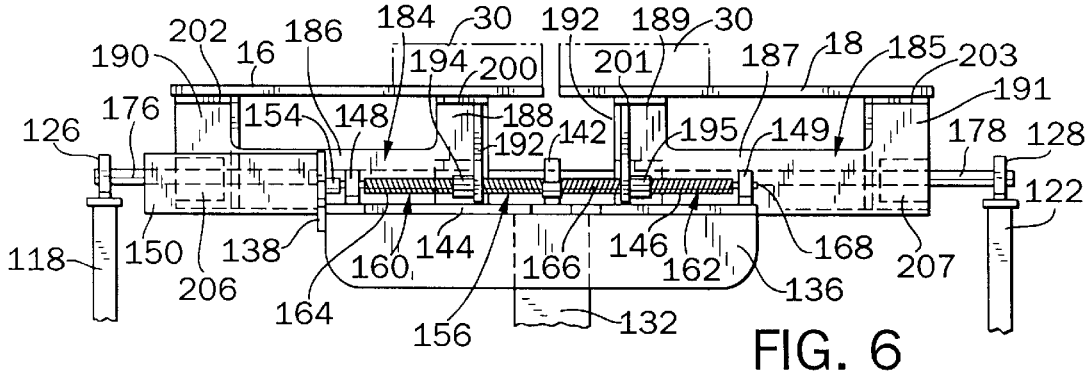
FIG. 6
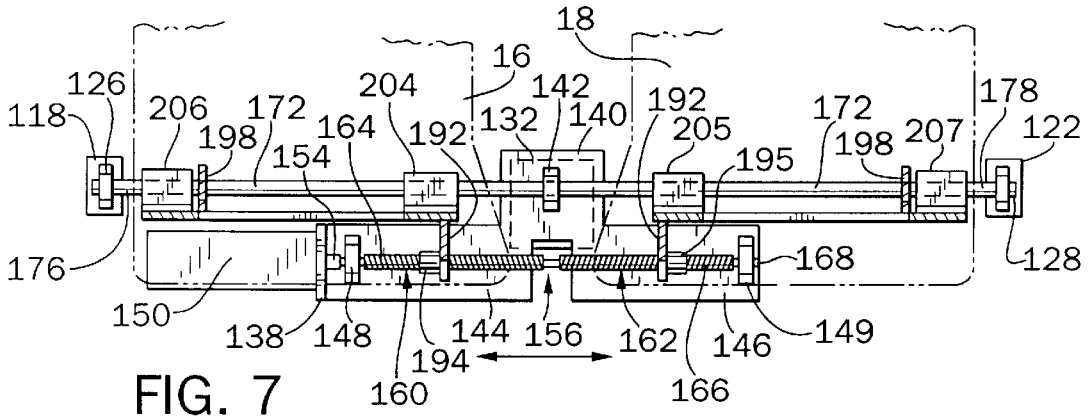
FIG. 7

FIG. 8
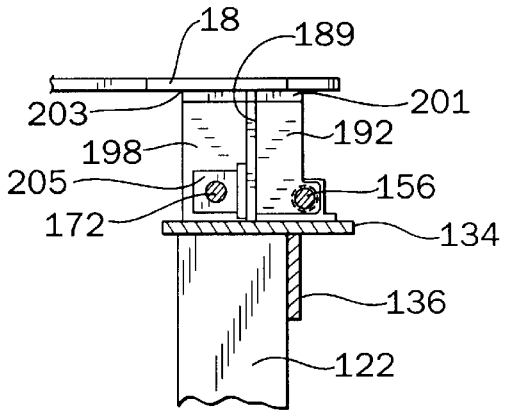
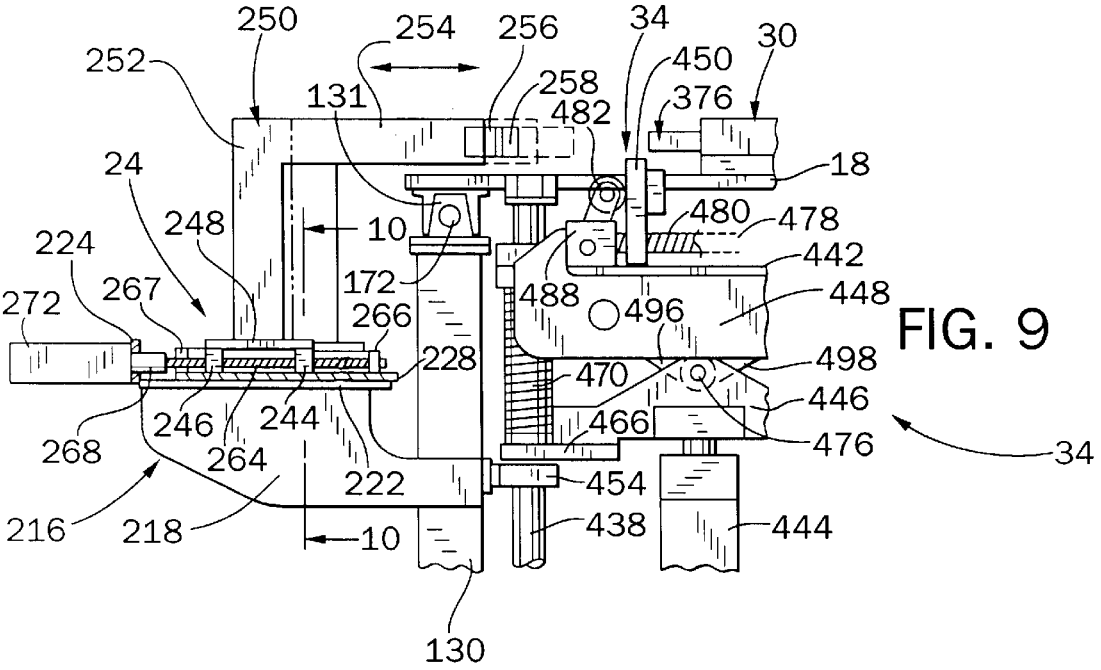
FIG. 9
FIG. 10
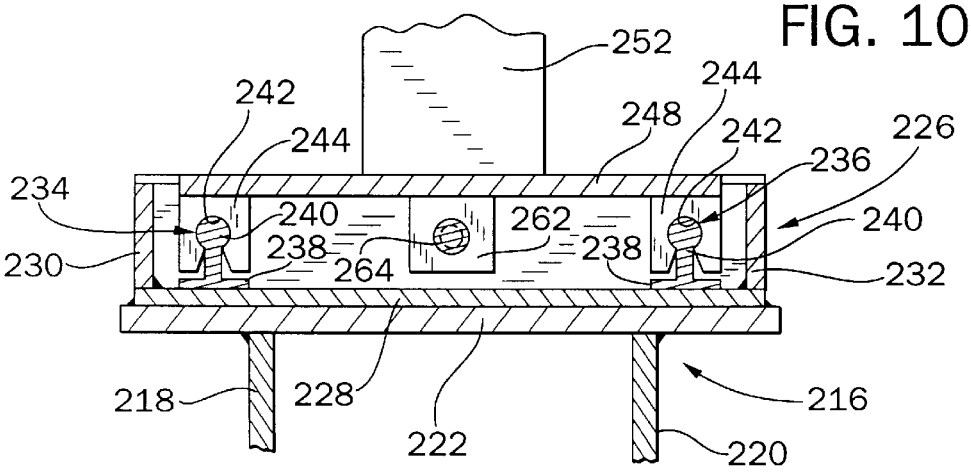

FIG. 22
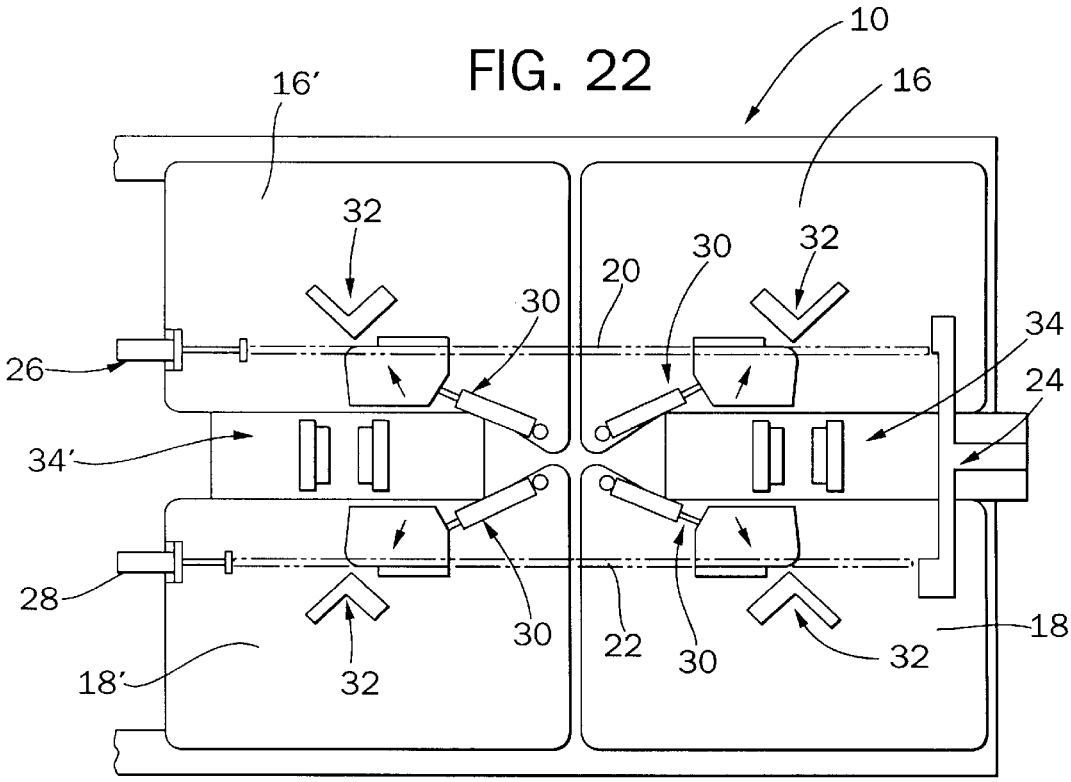
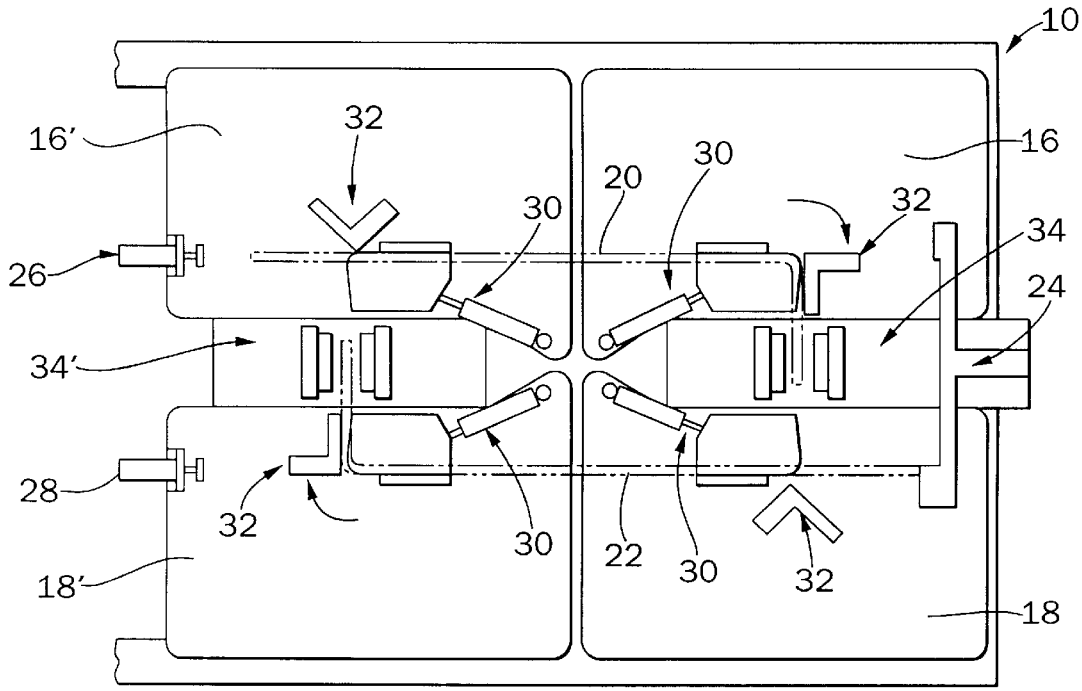
FIG. 23

FIG. 26
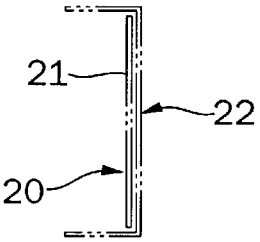
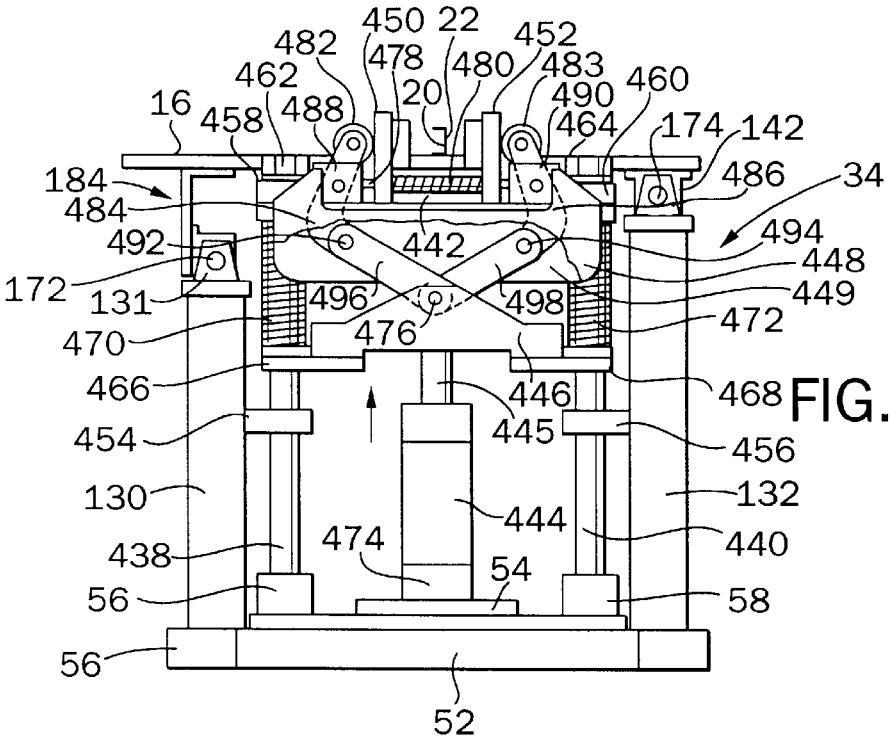
FIG. 27
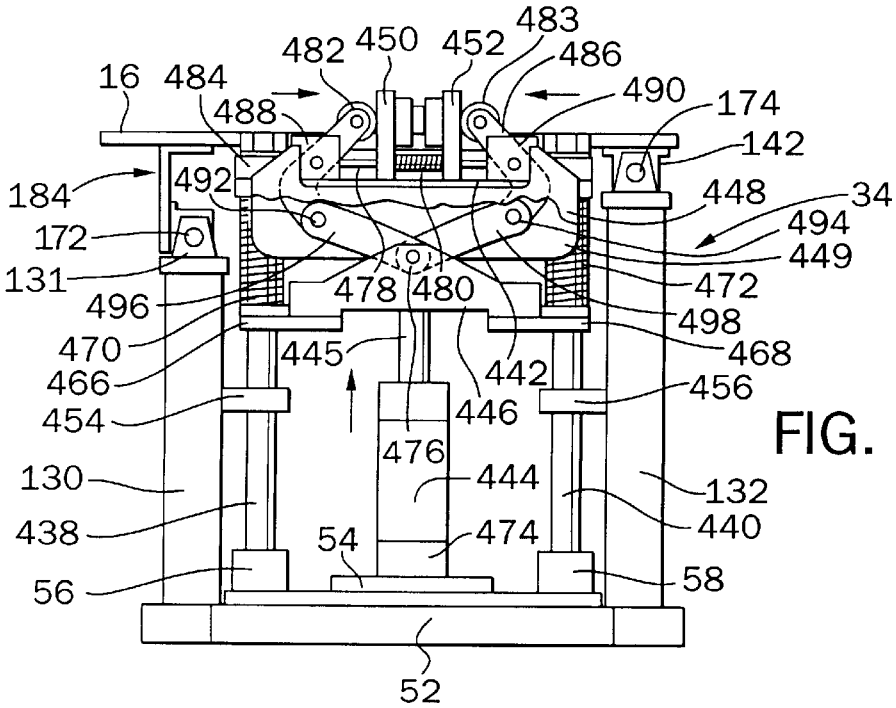
FIG. 28

APPARATUS AND METHOD FOR FORMING TABLE APRONS

FIELD OF THE INVENTION

This invention relates generally to frame forming equipment and, more particularly, pertains to an apparatus and method for bending and fastening elongated apron elements to form a closed table apron.

BACKGROUND OF THE INVENTION

In the production of folding banquet tables, it is well known to affix a frame or apron, of generally rectangular shape, to the underside of a tabletop to lend rigidity and reinforcement to the table. One machine commonly used to form aprons is known as a fixed single-headed bender, in which a continuous length of metallic stock material is first delivered along a guide path on a platform. The stock material is bent, usually at the discretion of an operator, at certain intervals into a rectangular configuration and cut to form the last side of the apron. The bent material is then transferred, sometimes manually, to another station where the cut ends of the apron are suitably formed together by a key, splice or welding to complete the rectangular frame assembly. In some instances, the stock material is supplied in discrete lengths so that the cutting step may be eliminated.

Other apron forming machines, known as two-headed benders, utilize a pair of spaced bending units which are movable along a single axis of an elongated frame component and cooperable with a clamping structure to form a first pair of right angle bends near the outer ends thereof. Once the initial pair of bends is formed, each of the bender heads is moved inwardly, the frame component is clamped and another pair of right angle bends is formed. As in the single headed bender, the bent framework is then transferred to a different location where the ends are joined together.

While each of these prior art frame bending machines can be utilized to effect bending of various frame components, they each have limitations which make them less than ideal for certain situations. For example, in using both of the machine types described above in the high volume production of table aprons, it is generally necessary to employ 1–3 workers who are responsible for the bending and cutting operations, the material handling of the bent frame and the final end forming function. Even with multiple workers, it has been found extremely time consuming to turn out sizable quantities of completed aprons. Regardless of the prior art bending designs, no provision has been made to efficiently bend a pair of apron sections in a manner such that the bent ends can be juxtaposed and fastened together on a support surface common to the bending operation. In addition, there is no known apron forming apparatus which provides a minimal mechanical set up for size changes in the frame or apron.

There are other drawbacks which arise in the use of these prior art frame bending machines. In the case of the single-headed bender, far too much emphasis is placed on the operator's judgment to make strategically positioned bends. With respect to the two-headed bender, long lengths of minimally supported stock material tend to bow in the middle between the bending units due to gravity, creating an irregularly shaped apron.

Although various bending systems have been devised for forming rectangular frames, there remains a need for a more efficiently designed apron forming apparatus which will satisfactorily combine bending and end forming functions in a common plane. Accordingly, it is desirable to provide an apron forming apparatus having a four headed bender design, each of the benders being adjustable along two separate axes in the common plane so as to readily accommodate different apron sizes. Likewise, it is desirable to provide an apron forming apparatus which will operate to accurately bend and position the ends of a pair of apron segments in an overlapping relationship which will facilitate an efficient joining of the segment ends to complete an apron. It is also desirable to provide an apron forming apparatus which will significantly reduce the cycle time to produce any desired apron size.

BRIEF SUMMARY OF THE INVENTION

It is a general object of the present invention to provide an improved frame forming apparatus and method which is versatile and highly effective to bend and join various lengths of stock material into frame members of different sizes. It is a primary object of the present invention to provide an apron forming apparatus for automatically bending and forming a pair of elongated apron segments in a common plane. It is also an object of the present invention to provide an apron forming apparatus having a series of bending and clamping arrangements which are adjustable along horizontal and vertical axes so as to allow for variously sized aprons. It is a further object of the present invention to provide a frame bending apparatus which will coordinate the bending of a pair of apron segments and position the ends thereof in an overlapping configuration conducive to an automated fastening process. It is an additional object of the present invention to provide an apron processing system which eliminates manual handling of the apron segments upon loading, manual bending of the apron segments once loaded, and manual unloading of the completed apron. It is another object of the present invention to provide an apron forming apparatus having a series of support surfaces movable with respect to each other in a common plane. It is yet another object of the present invention to provide an apron forming apparatus which will automatically position a pair of apron segments prior to bending and joining operations. Still yet another object of the present invention is to provide an apron forming apparatus for completing an apron from apron segments of a particular cross section which readily enables fastening of the apron to the underside of a table. Still yet another object of the present invention is to provide an apron forming apparatus compatible with an automatic loading and unloading system. Another object of the present invention is to provide a method of forming an apron adapted to be secured to the underside of a table. A further object of the present invention is to provide a method of coordinating the movement of a series of bending and clamping arrangements with a pair of apron segments to form an apron.

In one aspect of the invention, a system is provided for forming a frame from a pair of elongated frame components, each having a pair of end portions. The invention contemplates at least one support surface for supporting the frame components thereon. Frame forming equipment is constructed and arranged for sequentially clamping and bending the frame components on the support surface such that the end portions of one bent frame component are placed in overlapping relationship with the end portions of the other bent frame component. The frame forming equipment is also constructed and arranged for joining the overlapped bent end portions of the frame components, while the frame components are maintained on the support surface.

Another aspect of the invention relates to an apparatus for bending an elongated piece of stock material to form a bent frame component. The apparatus includes a framework having a longitudinal axis, and at least one pair of support surfaces lying in a common plane and mounted on the framework. At least one clamping arrangement is mounted on each of the support surfaces for selectively clamping the stock material. At least one bending arrangement is secured to each of the support surfaces for selectively bending the stock material, the stock material being clamped between the clamping arrangement and the bending arrangement. An activating mechanism is provided for selectively moving the bending arrangement into engagement with the clamping arrangement to bend the stock material. The invention contemplates an improvement in a mechanism for moving the clamping arrangement and the arrangement on certain of the support surfaces along a first axis substantially parallel to the longitudinal axis of the framework and a second axis substantially perpendicular to the first axis to form a bent frame component.

In another aspect of the invention, a frame forming apparatus is provided for bending and joining a pair of frame components, each having a pair of ends. The apparatus includes a series of four frame support surfaces lying in a common plane, and a clamping arrangement mounted on each of the frame support surfaces for selectively clamping a frame component. A bending arrangement is secured to each of the frame support surfaces for selectively bending a frame component. Each of the bending arrangements is movable into engagement with a frame component to bend the frame component about the clamping arrangement such that the ends of one of the bent frame components are placed in overlapping relationship with the ends of the other bent frame component. The invention provides a fastening arrangement having at least one pair of spaced apart fastening dies normally disposed beneath the common plane of the frame support surfaces and operable following overlapping of the bent end portions of the frame components to rise above the common plane of the frame support surface and clinch the bent overlapped end portions together.

The clamping arrangement includes a hydraulic clamping cylinder having a casing end pivotally mounted to a top side of the frame support surface. An anvil assembly is movably mounted on the top side of the frame support surface and is connected to a rod end of the clamping cylinder. A clamping block is fixed to the top side of the frame support surface and is spaced from the anvil assembly. The space between the anvil assembly and the clamping block defines a guide path for the frame component. The anvil assembly includes a stationary anvil fixed to the frame support surface, and a clamping anvil slidably attached to the stationary anvil and connected to the clamping cylinder rod. The stationary anvil and the clamping anvil each have a first straight surface running along one side of the frame component. A second surface extends at an angle slightly less than 90° with respect to the first surface and a rounded corner connects the first and second surfaces and defines a 90° arc. The first and second surfaces and rounded corner of the clamping anvil are alignable with the first and second surfaces and rounded corner of the stationary anvil. The clamping block includes a horizontal leg fixed to each frame support surface and a vertical leg extending perpendicularly from the horizontal leg and lying along the other side of the frame component.

In the frame forming apparatus, the bending arrangement includes a bending cylinder having a casing end suspended from a bottom side of each frame support surface. A rocker arm is connected to a rod end of the bending cylinder and a first pivot pin extends through an arcuate slot formed in the support surface and has a bottom end swingably mounted to the rocker arm. A form bar is pivotally mounted to an upper end of the first pivot pin. A second pivot pin extends through the slot and has an upper end pivotally mounted in the form bar. A cam plate is secured to a bottom side of the form arm and a bend arm is attached to the bottom end of the second pivot pin. The form bar is an L-shape construction having a first leg and a second leg joined perpendicularly to the first leg. The second leg of the form bar is provided with a wear strip which is engageable with a frame component during the bending thereof. The first leg includes a raised portion at a distal end thereof, and a block portion at a proximal end thereof. The first pivot pin is located in the raised portion of the form bar and the second pivot pin is positioned in the block portion of the form bar.

In yet another aspect of the invention, an apron forming apparatus is provided for bending and joining a pair of apron half segments, each having a pair of ends. The apparatus includes a series of four apron support surfaces lying in a common plane, and a clamping arrangement is mounted on each of the apron support surfaces for selectively clamping an apron half segment. A bending arrangement is secured to each of the apron support surfaces for selectively bending an apron half segment. Each of the apron half segments is disposed between the clamping arrangement and the bending arrangement on a pair of apron support surfaces, such that the apron half segments lie substantially parallel to each other. Each of the bending arrangements is movable into engagement with an apron half segment to bend the apron half segments such that the ends of one bent apron half segment are placed in overlapping relationship with the ends of the other bent apron half segment. The invention provides a fastening arrangement for joining the overlapped ends of the bent apron half segments while the apron half segments are positioned on the apron support surfaces. The clamping arrangement includes an anvil assembly having a stationary anvil fixed to the apron support surface and a clamping anvil movably mounted on the stationary anvil. The stationary anvil is formed with a peripheral surface provided with an inwardly extending channel formed by an upper lip and a lower lip, the upper lip defining a shallow niche therein. The clamping arrangement also provides a peripheral surface having an inwardly extending pocket formed by an upper band and a lower band. The clamping arrangement further includes a clamping block spaced from the anvil assembly. Each of the apron half segments is C-shaped in cross section and has an upper horizontal wall, a lower horizontal wall and a vertical wall connected to the upper and lower horizontal walls at a right angle.

The bending arrangement includes a form bar which is pivotally mounted on each of the apron support surfaces. The form bar carries an attachment plate having an edge which is movable into and out of the inwardly extending pocket on the clamping anvil during bending of each apron half segment. A cam plate is mounted on a bottom surface of the form bar and includes a camming edge in constant engagement with the inwardly extending channel in the stationary anvil. The bending arrangement is further provided with a bend arm which is pivotally mounted to the stationary anvil. The bend arm is a wishbone-shaped element having a first finger and a second finger spaced from the first finger. An adjusting screw is threaded through the second finger to control the direction of wrinkling of the apron half segment during forming of the apron. The clamping arrangement is movable to position the lower band of the pocket into conforming relationship with an interior portion of the C-shaped apron half segment such that the vertical wall of the apron half segment is clamped between the clamp block and the clamping anvil. The lower horizontal wall of the apron half segment is clamped in the niche between the lower band of the clamping anvil and the upper lip of the stationary anvil. The apparatus also contemplates an alignment arrangement for positioning each of the apron half segments along a longitudinal axis of the apparatus on a pair of the apron support surfaces. The alignment arrangement includes a push rod assembly engageable with one end of each apron half segment and a back gauge assembly engageable with the other end of the apron half segment.

Another aspect of the invention relates to a method of forming an apron adapted to be secured to the underside of a table from a pair of apron half segments, each having a pair of ends. The method includes the steps of establishing a series of four apron support surfaces lying in a common plane; providing a clamping arrangement on each of the apron support surfaces; supplying a bending arrangement on each of the apron support surfaces; positioning each of the apron half segments between the clamping arrangement and the bending arrangement on a pair of apron support surfaces such that the apron half segments lie substantially parallel to each other; moving each of the bending arrangements into engagement with the apron half segments to bend the apron half segments such that the ends of one apron half segment are placed in overlapping relationship with the ends of the other apron half segment; and joining the overlapped ends of the bent apron half segments while the apron half segments remain in position on the apron support surfaces.

Still yet another aspect of the invention relates to a method of bending a pair of apron half segments, each having a pair of ends. The method includes the steps of establishing a framework having a longitudinal axis; mounting a series of four apron support surfaces lying in a common plane upon the framework; enabling movement of certain of the apron support surfaces relative to the framework along a horizontal axis substantially parallel to the longitudinal axis of the framework and a vertical axis substantially perpendicular to the horizontal axis; providing a clamping arrangement on each of the apron support surfaces; supplying a bending arrangement on each of the apron support surfaces; engaging each of the apron half segments with a clamping arrangement and the bending arrangement on a pair of apron support surfaces such that the apron half segments are substantially parallel to each other and to the longitudinal axis of the framework; and moving each of the bending arrangements into engagement with the apron half segments to bend the apron half segments about a peripheral portion of the clamping arrangement such that the ends of the apron half segments are placed in overlapping relationship with the ends of the other apron half segments.

Yet another aspect of the invention pertains to an apron forming apparatus for bending and joining a pair of apron half segments, each having a pair of ends. The apparatus includes a stationary framework having a longitudinal axis, and a movable frame slidably mounted on the stationary framework. First and second apron support surfaces are mounted on the stationary framework, while third and fourth apron support surfaces are attached to the movable frame. The first, second, third and fourth apron support surfaces all lie in a common plane. A clamping arrangement is secured to each of the first, second, third and fourth apron support surfaces for selectively clamping an apron half segment. A bending arrangement is positioned on each of the first, second, third and fourth apron support surfaces for selectively bending an apron half segment. Each of the bending arrangements is engaged with an apron half segment to bend the apron half segments such that the ends of one bent apron half segment are placed in overlapping relationship with the ends of the other apron half segments. A first drive system is mounted on the stationary framework for moving the third and fourth apron support surfaces along a horizontal X-axis lying parallel to the longitudinal axis of the stationary framework and in the common plane. A second drive system is mounted on the first and second apron support surfaces for moving the first and second support surfaces along a vertical Y-axis lying perpendicular to the horizontal X-axis and in the common plane. A third drive system is mounted on the third and fourth apron support surfaces for moving the third and fourth apron support surfaces along the vertical Y-axis. A first fastening system is mounted on the stationary framework between the first and second apron support surfaces for fastening one pair of bent overlapping apron half segment ends. A second fastening system is mounted on the movable frame between the third and fourth apron support surfaces for fastening the other pair of bent overlapping apron half segment ends. The first and second fastening systems are each movable above and below the first, second, third and fourth apron support surfaces along a vertical Z-axis lying perpendicular to the common plane. The stationary framework includes a pair of parallel side tubes, each having a guide rail fixed thereon. The movable frame includes a set of bearing brackets for matingly receiving each guide rail on the stationary framework. The first drive system includes a first servo motor mounted on the stationary framework in the vicinity of the second fastening system. A main ball screw having one end connected to the first servo motor and another end connected to the stationary framework is located beneath the first and second apron support surfaces. A ball nut is secured on the movable frame for threaded engagement with the main ball screw. The second drive system includes a second servo motor mounted beneath the first apron support surface. A first supplementary ball screw arrangement is connected with the second servo motor between and beneath the first and second apron support surfaces. A first ball nut is connected to a first support structure for the first apron support surface, and a second ball nut is connected to a second support surface for the second apron support surface. The first and second ball nuts are in threaded engagement with the first supplementary ball screw arrangement. The third drive system includes a third servo motor mounted beneath the fourth apron support surface. A second supplementary ball screw arrangement is connected with the third servo motor between and beneath the third and fourth apron support surfaces. A third ball nut is connected to the third apron support surface and a fourth ball nut is connected to the fourth apron support surface. The third and fourth ball nuts are in threaded engagement with the second supplementary ball screw arrangement.

The invention further contemplates first and second apron support surfaces being slidably mounted on a first set of guide rods extending across the stationary framework and third and fourth apron support surfaces being slidably mounted on a second set of guide rods extending across the movable frame. The apron forming apparatus includes an alignment arrangement for positioning one of the apron half segments on the first and third apron support surfaces and the other of the apron half segments on the second and fourth apron support surfaces. The alignment arrangement includes a pair of push rod assemblies, one being mounted on the outer end of the third apron support surface and the other being mounted on the outer end of the fourth apron support surface. Each of the push rod assemblies has a slidable push rod provided with a pusher face engageable with a first end of an apron half segment, and a pneumatic cylinder for selectively moving the pusher face against the segment end. The alignment arrangement further includes a back gauge assembly mounted on an outer end of the stationary framework opposite the push rod assemblies. The back gauge assembly has a bracket attached to a vertical frame member on the stationary framework and has a horizontal mounting plate with an upstanding mounting wall. A U-shaped slide is fixed on the horizontal mounting plate, and a pair of spaced guide rails are attached to the U-shaped slide. An L-shaped arm has a base plate provided with a set of brackets slidably mounted on the guide rails and has a ball nut depending therefrom. A ball screw has one end supported for rotation on the U-shaped slide and another end coupled for driving engagement with the fourth servo motor supported by the upstanding mounting wall. The ball screw is in threaded engagement with the ball nut. The L-shaped arm carries a cross bar having a pair of apron engaging pads, each being engageable with a second end of the apron half segment. Each of the first and second apron support surfaces are respectively mounted on first and second U-shaped table top supports fixed on opposite sides of a stationary support post secured on the stationary framework. Each of the third and fourth apron support surfaces are respectively mounted on third and fourth tabletop supports secured on opposite sides of a movable servo post joined to the movable frame. The bending arrangements are engageable with the apron half segments to effect four separate 90° bends in the common plane to provide a rectangular table apron.

Yet another aspect of the invention contemplates an apparatus for forming an apron from a pair of bent apron half segments having respective ends adapted to be placed in overlapping relationship. The invention relates to an improvement in a fastening system having a pair of fastening dies for securing the overlapped ends of the bent apron half segments. The fastening system is constructed and arranged to translate an upper force by means of a linkage arrangement into an inwardly directed horizontal clinching force for moving the fastening dies together on either side of the overlapped ends of the bent apron half segments. The fastening system includes a support framework, and a pair of parallel guide bars having upper ends, medial portions and lower ends mounted on the support framework. A horizontal base plate joins the upper ends of the guide bars, and a pair of parallel vertical side plates depend from the horizontal base plate. A pair of engaging pads are mounted on the medial portions of the guide bars, and a pair of coil springs are mounted on the guide bars between the horizontal base plate and the engaging pads. A lift cylinder is mounted on the support framework and includes a rod end connected to a cross bar having opposite ends attached to the engaging pads so that the cross bar is movably mounted on the guide bars. Each of the fastening dies is movably mounted on a pair of parallel die rods secured on the horizontal base plate, there being a coil spring on each die rod between the fastening dies for biasing the fastening dies outwardly. A pair of rollers is provided for engaging the fastening dies. The linkage arrangement is connected between the rollers and the lift cylinder rod. The linkage arrangement includes a pair of links having lower ends connected to the lift cylinder rod and having upper ends pivotally connected to the vertical side plates. The linkage further includes a pair of bell cranks having lower ends pivotally attached to the upper ends of the links and upper ends secured to the rollers.

Various other features, objects and advantages of the invention will be made apparent from the following description taken together with the drawings.

BRIEF DESCRIPTION OF THE SEVERAL VIEWS OF THE DRAWING

The drawings illustrate the best mode presently contemplated of carrying out the invention.

In the drawings:

FIG. 5 is a cross-sectional view taken on line 5—5 of FIG. 1;

FIG. 6 is a cross-sectional view taken on line 6—6 of FIG. 2;

FIG. 7 is a partial cross-sectional view taken on line 7—7 of FIG. 5;

FIG. 8 is a cross-sectional view taken on line 8—8 of FIG. 5;

FIG. 9 is a cross-sectional view taken on line 9—9 of FIG. 1;

FIG. 10 is a cross-sectional view taken on line 10—10 of FIG. 9;

FIGS. 20–24 are diagrammatic plan views showing sequential operation of the apron forming apparatus upon a pair of apron half segments;

FIG. 26 is an enlarged detail view of nested male and female end portions of apron half segments prior to their joining; and FIGS. 27 and 28 are cross-sectional views similar FIG. 25 showing sequential operation of the fastening systems in forming the apron half segments to form a completed apron.

DETAILED DESCRIPTION OF THE INVENTION

Figure 1:
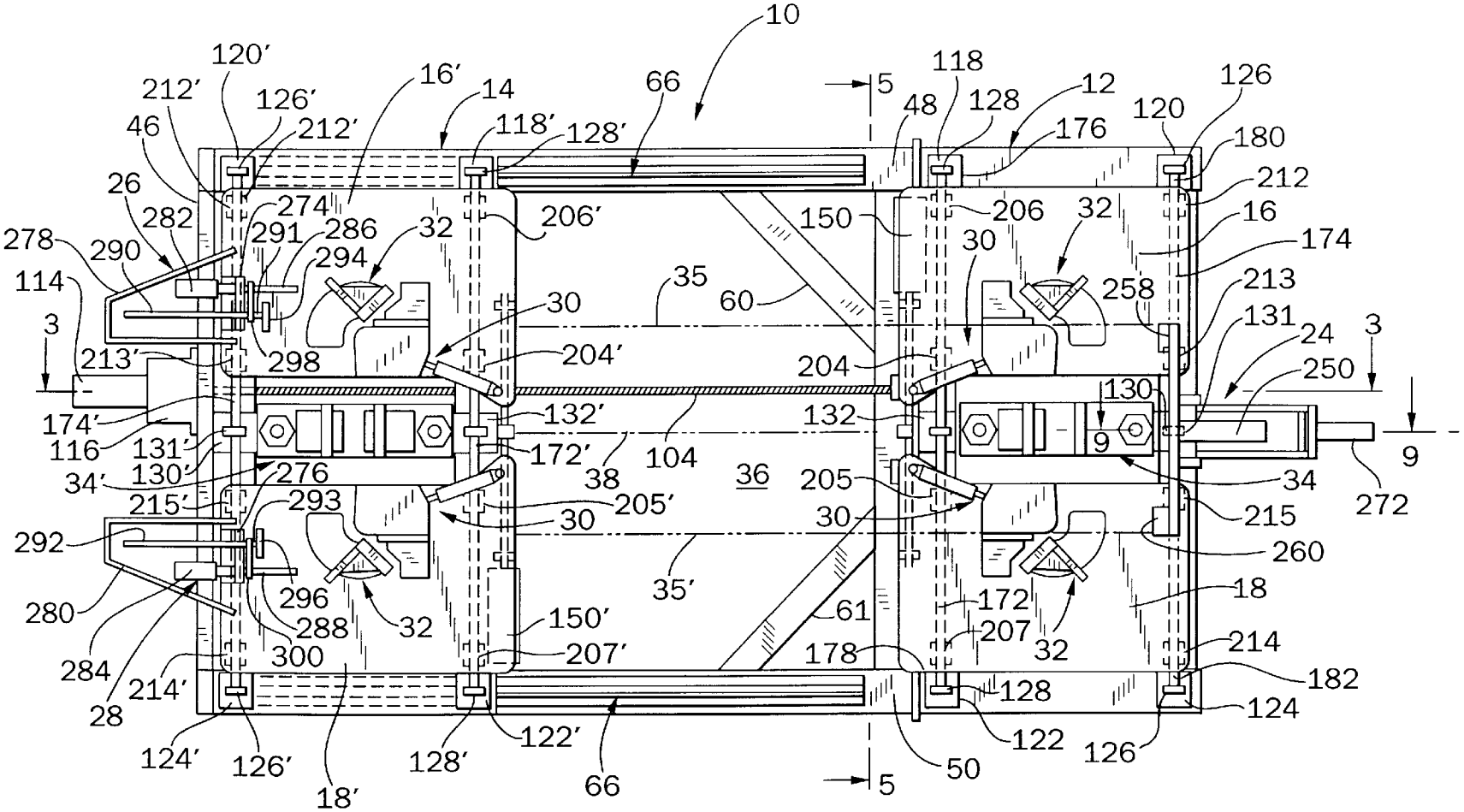
FIG. 1 is a top plan view of an apparatus for forming a particularly sized table apron in accordance with the present invention.

Referring now to the drawings, a preferred embodiment of frame forming apparatus 10 is automatically controlled for producing metallic reinforcing frames or aprons of generally rectangular configuration. Such aprons are adapted to be fixedly attached to the underside of a tabletop of a conventional folding banquet table between the periphery of the table and a folding leg stand. In the preferred apparatus and method, elongated straight, discrete lengths of metallic stock material in the form of apron half segments are delivered into an automatic loading system (not shown), comprised of an indexing magazine and a robotic arm or other pick and place mechanism, which initially positions a pair of apron segments upon a set of coplanar support surfaces. Each of the straight apron segments is automatically formed with two right angle bends such that the ends of the segments assume an overlapping relationship in which they may be positively fastened together while lying on the coplanar support surfaces. Following apron formation, the apron is placed on and secured to the underside of the tabletop. With the apron mounted to the tabletop, folding legs are placed inside the periphery of the apron and anchored to the underside of the tabletop to form a completed table.

It should also be understood that while the preferred embodiment is particularly useful in producing table aprons, the forming apparatus may also be employed to provide any type of frame for any type of goods requiring a reinforcing structure.

Figure 2:
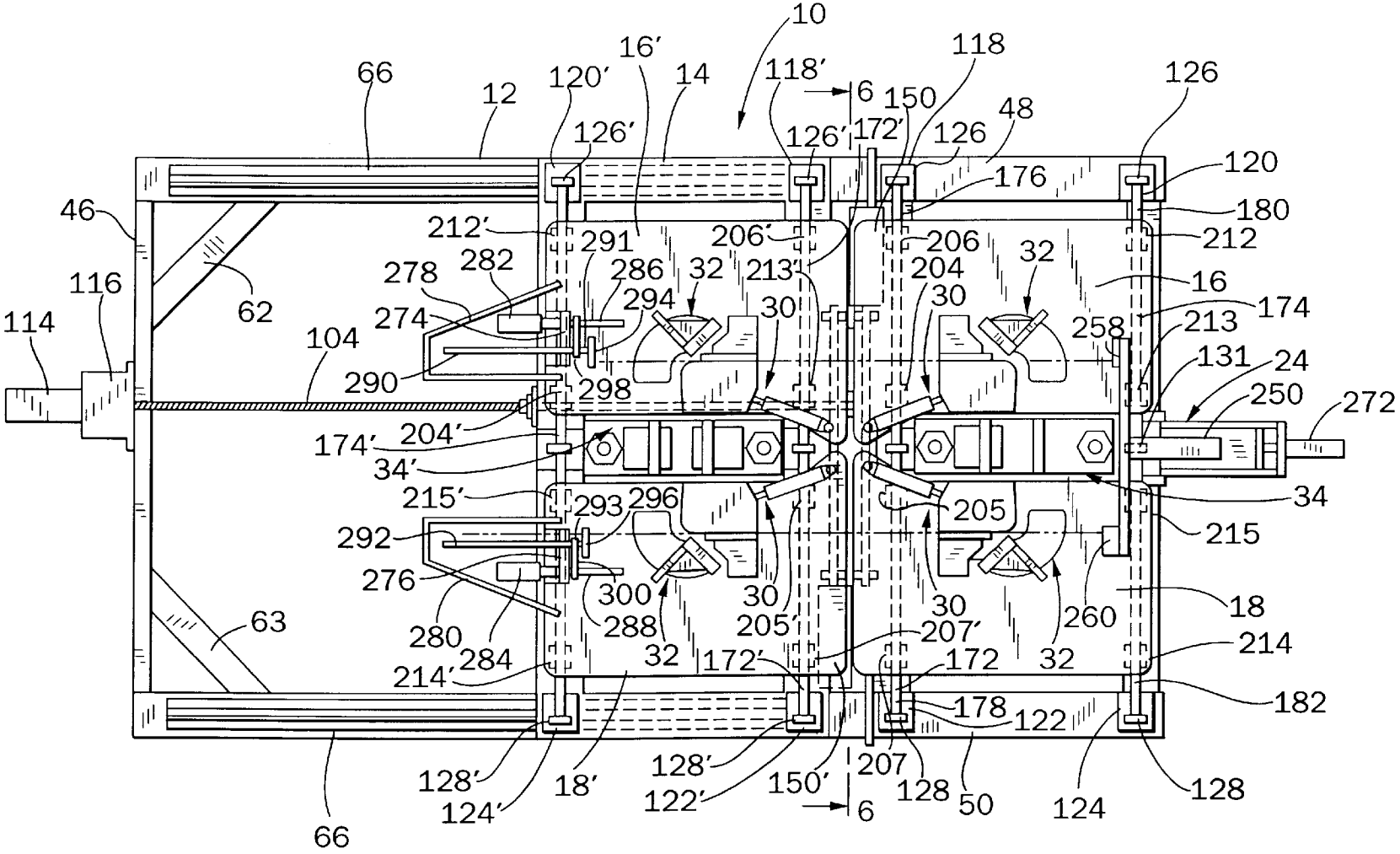
FIG. 2 is a top plan view similar to FIG. 1 but showing the apparatus adapted to form a differently sized apron.

FIGS. 1 and 2 illustrate an apron forming apparatus 10 constructed according to the invention, each figure being employed to show an adaptation for producing a table apron of a particular size. Apron forming apparatus 10 generally includes a stationary framework 12, a movable frame 14, a series of support surfaces 16, 16', 18, 18' for supporting a pair of apron half segments 20, 22, a back gauge assembly 24, a pair of push rod assemblies 26, 28, a clamping arrangement 30 for each support surface, a bending arrangement 32 for each support surface, and a pair of apron fastening systems 34, 34' for securing bent end portions of the apron half segments.

As seen collectively in FIGS. 1–4, the various components of apron forming apparatus 10 are mounted to and supported by stationary framework 12 which is disposed upon a flat floor 36 at a suitable assembly site. Framework 12 has a generally rectangular configuration with a longitudinal axis 38 passing therethrough, and includes a set of three solid transverse frame members 40, 42, 44 (FIG. 3) and a C-shaped channel 46 interconnected by a pair of spaced, parallel side tubes 48, 50 (FIG. 4) of generally rectangular cross-section. A first support girder 52 extending parallel to the side tubes 48, 50 is joined across the transverse frame members 40, 42 at a point midway along the length thereof. The support girder 52 carries a centrally located support plate 54 and a pair of upstanding cylindrical collars 56, 58 on either side thereof and is employed to mount first apron fastening system 34 to be more fully described below. A first pair of diagonally extending struts 60, 61 (FIG. 1) are provided to rigidify framework 12, each of the struts 60, 61 extending from a midportion of transverse frame member 44 to a respective side tube 48, 50. A second pair of diagonally extending struts 62, 63 (FIG. 2) extend from the C-shaped channel 46 to a respective side tube 48, 50. Framework 12 has a length and a width which substantially defines the working space or footprint occupied by the apron forming apparatus 10.

Figure 3:
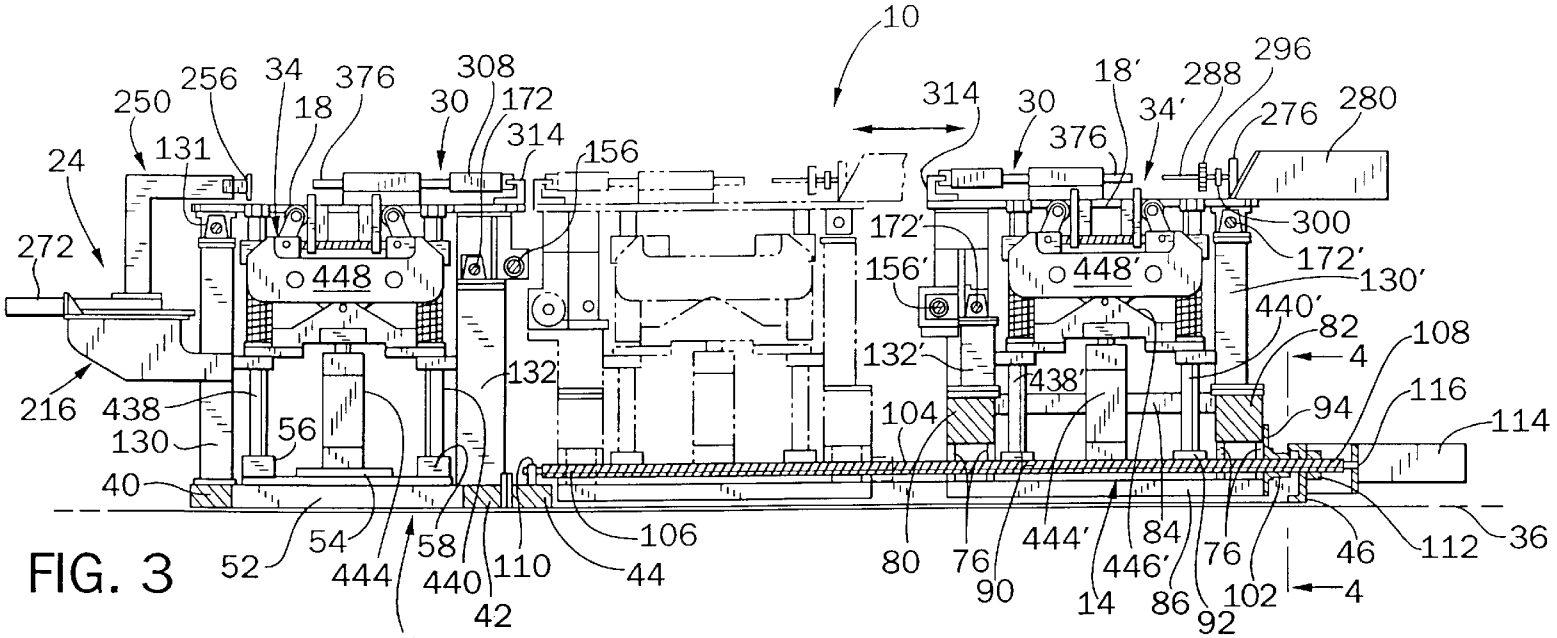
FIG. 3 is a cross-sectional view taken on line 3—3 of FIG. 1.

Each of the side tubes 48, 50 carries an elongated flat plate 64 which extends along the top portion thereof for substantially two thirds of its length. Anchored upon each of the side tubes 48, 50 and running parallel to the longitudinal axis 38 is a guide rail 66 having a vertical slide portion 68 which is key-shaped in cross-section, and a horizontal mounting portion 70 of flat cross-section which is adjoined to one of the flat plates 64. The guide rails 66 are captively received in mating keyhole-shaped openings 72, 74 formed in a set of spaced bearing brackets 76, 78 depending downwardly from each of the ends of a pair of spaced, parallel solid beams 80, 82. A series of cross pieces 84 (only one of which is seen in FIG. 3) interconnect the top portions of the beams 80, 82 at each end thereof. A second support girder 86 is secured by fastening blocks (not shown) to the bottom of the beams 80, 82 equidistant between the ends thereof such that the underside of the second support girder 86 is spaced slightly above the floor 36. Like the first support girder 52, second support girder 86 is provided with a mounting plate 88 and a pair of upstanding cylindrical collars 90, 92 to receive second apron fastening system 34'. Together the bearing brackets 76, 78, the beams 80, 82, the cross pieces 84 and the second support girder 86 define rectangular movable frame 14 which is slidably mounted with respect to the larger, rectangular stationary framework 12.

Figure 4:
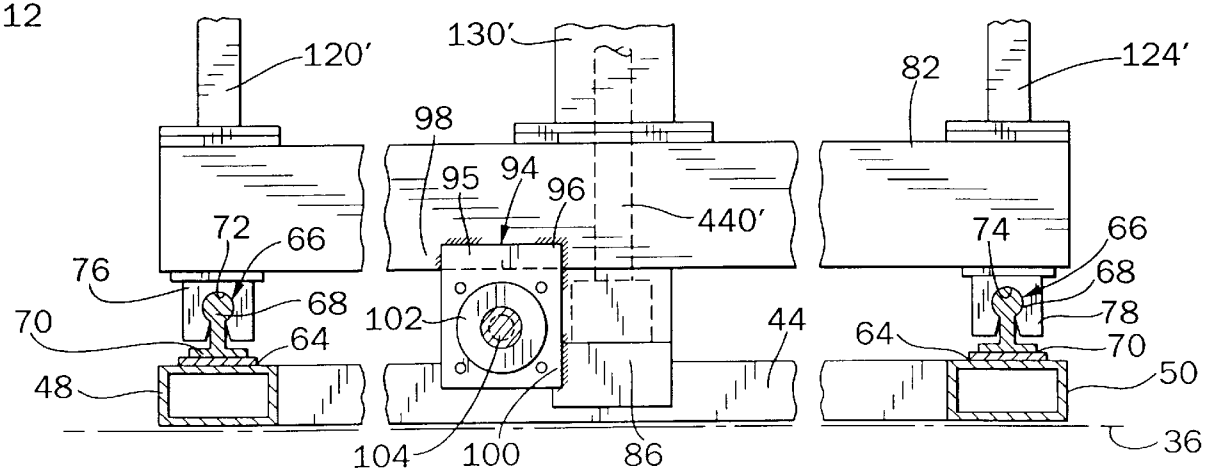
FIG. 4 is a cross-sectional view taken on line 4—4 of FIG. 3.

Referring to FIGS. 3 and 4, in order to propel the movable frame 14 along the length of the stationary framework 12, apparatus 10 includes a first drive system having a rectangular support plate 94 which is attached along its upper corners 95, 96, such as by welding, to a lower, external side section 98 of beam 82. Support plate 94 is also welded along its lower side portion 100 to an outer end of second support girder 86. Support plate 94 holds a generally cylindrical ball nut 102 which threadably receives a horizontally oriented, main ball screw 104 having an inner end portion 106 and an outer end portion 108. Inner end portion 106 is disposed for rotation in a bearing block 110 mounted atop the upper face of transverse frame member 44. Outer end portion 108 is supported in a bearing block 112 fixed to the C-shaped channel 46 and is connected for driving rotation to a first servo motor 114 having a housing 116 which is fastened to the exterior of C-shaped channel 46 around the bearing block 112. Activation of first servo motor 114 will turn main ball screw 104 relative to ball nut 102 such that the movable frame 14 is adjustable back and forth longitudinally along the fixed guide rails 66 on stationary framework 12. As will be more fully understood, the first drive system helps to establish longitudinal coordinates for the bending and clamping arrangements 30, 32 used in making a particular sized apron.

As best seen in FIGS. 1–3, the stationary framework 12 includes a series of four parallel, upright support columns 118, 120, 122, 124, one pair 118, 120 being spaced apart on side tube 48 and another pair 120, 122 being equally spaced apart on the opposite side tube 50. Support columns 120, 124 are similar in height and the top of each is provided with a bearing block 126. Support columns 118, 122 are shorter than support columns 120, 124 and the top of each is also supplied with a bearing block 128. A vertical frame member 130 rises upwardly from the outermost end of the first support girder 52 between the support columns 118, 120, and is topped with a bearing block 131. A vertical stationary support post 132 ascends from the innermost end of the first support girder 52 and, as shown in FIGS. 5 and 6, is formed with a horizontally extending shelf 134, a skirt 136 depending perpendicularly and downwardly from the shelf 134, and a vertically oriented servo mounting plate 138 joined at a right angle to the shelf 134. FIG. 7 illustrates the shelf 134 being constructed of a substantially central portion 140 upon which a bearing block 142 is supplied, and a pair of generally rectangular, laterally extending portions 144, 146, each of which also supports a respective bearing block 148, 149 at an outer end thereof.

A second servo motor 150 is supported from the molting plate 138 and includes an output shaft which is drivingly connected via a coupling 154 to one end of a first supplementary ball screw arrangement 156 disposed for rotation in bearing block 148. Supplementary ball screw arrangement 156 is integrally formed with a first screw section 160 and a second screw section 162. First screw section 160 has external threads 164 oriented in one direction, while second screw section 162 has external threads 166 oriented in a reverse direction relative to the first screw section 160, and an end 168 rotatably supported in bearing block 149.

Referring to FIGS. 1–3 and 5–8, a first cylindrical inner guide rod 172 spans the distance between the upright support columns 118, 122, while a first cylindrical outer guide rod 174 (FIGS. 1–3) extends across the support columns 120, 124. Guide rods 172, 174 define a path of travel for certain components along the width of the apron forming apparatus 10. First inner guide rod 172 has a medial portion which is supported in shelf bearing block 142 and has end portions 176, 178 which are respectively mounted in upright support column bearing blocks 126, 128. First outer guide rod 174 has a medial portion supported in the vertical frame member bearing block 130 and has end portions 180, 182 which are respectively mounted in upright support column bearing blocks 126, 128.

A pair of identical, U-shaped tabletop supports 184,185, best seen in FIGS. 5 and 6, are provided, each being located on an opposite side of the stationary support post 132. Each tabletop support 184, 185 has a respective bight portion 186, 187 and a pair of respective inner and outer upstanding legs 188, 189, and 190, 191. Extending inwardly from each of the inner legs 188, 189 is a vertically oriented L-shaped support plate 192 (FIG. 8) which carries a ball nut 194 or 195 having an internally threaded bore 196 aligned with an aperture formed in the support plate 192. First screw section 160 passes through the one aperture and is threaded into ball nut 194, while second screw section 162 passes through the other aperture and is threaded into the other ball nut 195. Extending outwardly from each of the outer legs 190, 191 is a vertically oriented, rectangularly shaped support plate 198 (FIG. 8) formed with an aperture through which the first inner guide rod 172 freely passes. The top of each inner leg 188, 189 is formed with a respective horizontally extending support ledge 200, 201 lying orthogonally to the L-shaped support plates 192 and parallel with the stationary support post shelf 134. Similarly, the top of each outer leg 190, 191 is also formed with a respective horizontal external support ledge 202, 203 which lies perpendicular to the support plate 192 and parallel to the stationary support post shelf 134. Secured to the bottom of each inner leg 188, 189 beneath support ledge 200, 201 is a respective bearing block 204, 205 through which first inner guide rod 172 passes. In like fashion, the bottom of each outer leg 190, 191 beneath support ledge 202, 203 includes a respective bearing block 206, 207 through which first inner guide rod 172 passes.

Figures 11, 12:
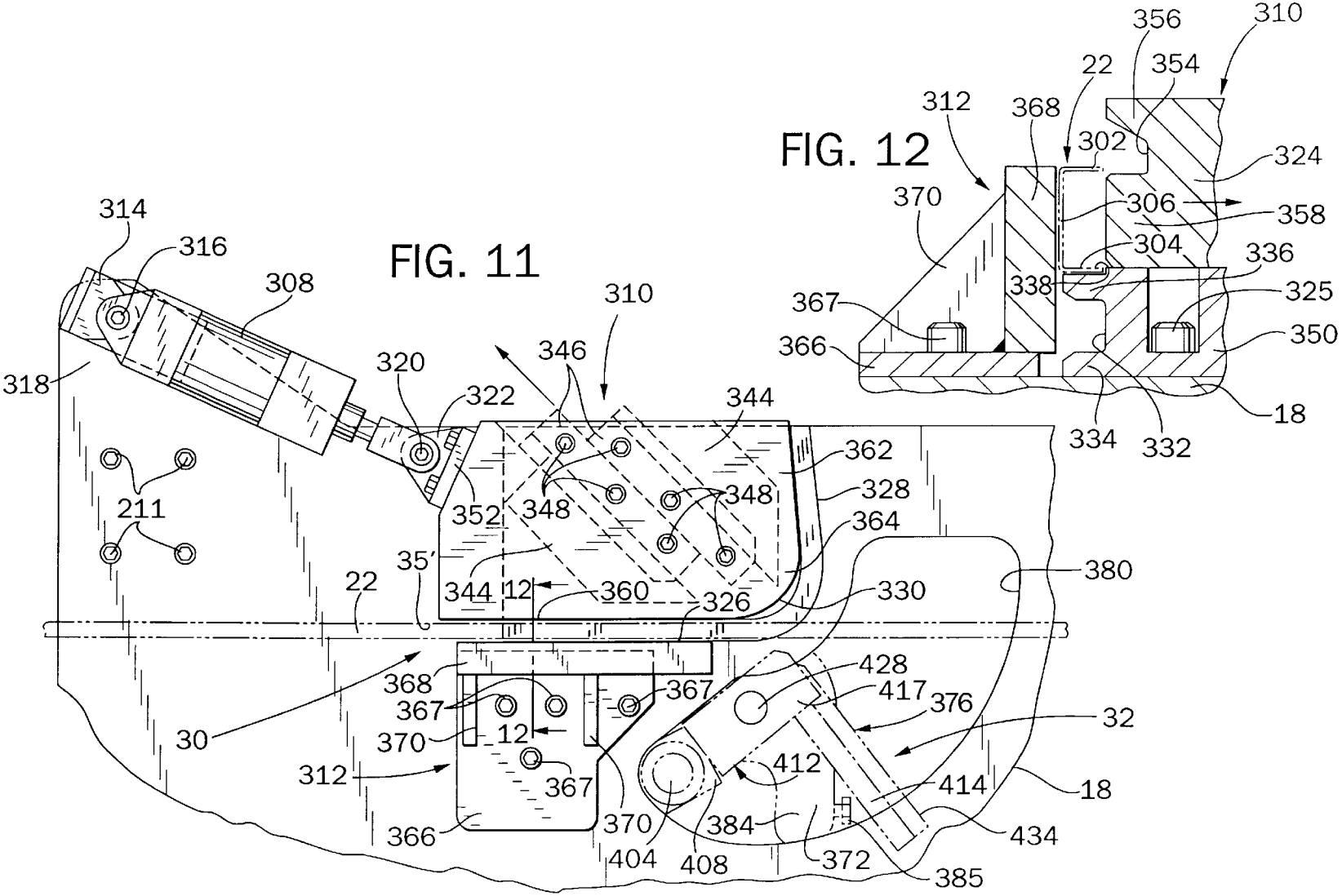
FIG. 11 is a fragmentary, plan view of an elongated apron half segment disposed in an unclamped position between clamping and bending components on one support surface of the apron forming apparatus.
FIG. 12 is a cross-sectional view taken on line 12—12 of FIG. 11.

Ledges 200, 202 are utilized to bear a substantially rectangular first tabletop or flat support surface 16 which is affixed thereto such as with fasteners 210 (FIG. 11). In similar fashion, ledges 201, 203 function to uphold a second flat, support surface 18 adjacent to and coplanar with the first support surface 16. As shown in dotted lines in FIGS. 1 and 2, the bottom of the first support surface 16 opposite bearing block 206 carries a bearing block 212 which is supported on first outer guide rod 174 near one end thereof. In addition, the bottom of first support surface 16 opposite bearing block 204 carries a bearing block 213 which is supported on first outer guide rod 174. Similarly, the bottom of second support surface 18 opposite bearing block 207 carries a bearing block 214 also supported on first outer guide rod 174 near the other end thereof. The bottom of second support surface 18 opposite bearing block 205 carries a bearing block 215 also supported on first outer guide rod 174. As will be further explained, the support surfaces 16, 18 are employed to carry the bending and clamping arrangements 30, 32 as well as the elongated workpieces or apron segments 20, 22 to be bent and joined. With the structure set forth above, actuation of the second servo motor 150 will rotate the first supplementary ball screw arrangement 156 such that tabletop supports 184, 185 and their respective support surfaces 16, 18 are drawn towards each other as shown in FIG. 6. Rotation of the supplementary feed screw arrangement 156 in the opposite direction will move the tabletop supports 184, 185 and respective support surfaces 16, 18 apart to a position such as shown in FIGS. 5 and 7.

It should be understood that the structure associated with stationary framework 12 previously described above applies to the movable frame 14 shown on the left side of FIG. 1, and corresponding elements thereon will be identified by like reference numerals where possible to facilitate clarity. However, as seen in FIGS. 1–3, it is noted that the location of a third servo motor 150' is diagonally opposite second servo motor 150, rather than directly across from the second servo motor 150. In addition, the height of the upright support columns 118', 122' and movable servo post 132' are chosen so as to dispose a second supplementary ball screw arrangement 156' and a second inner guide rod 172' at elevations which will allow the transfer of the movable frame 14 and its components to the phantom line position of FIG. 3.

It should also be appreciated from the structure described above that the apron-forming apparatus 10 defines a series of four coplanar, movable support surfaces 16, 16', 18, 18', each of which is used to mount a respective clamping arrangement 30 and a respective bending arrangement 32. In addition, one pair of the support surfaces 16, 16' serves to support one apron half segment 20 (FIGS. 20–24) along a path 35 shown in phantom in FIGS. 1 and 2. The other pair of support surfaces 18, 18' functions to support another apron half segment 22 (FIGS. 20–24) along a path 35' parallel to the path 35. It is an important feature of the invention that each support surface 16, 16', 18, 18', along with its bending and clamping components, is movable before any bending or joining operations so as to selectively enable the forming of different sized aprons. In particular, support surfaces 16', 18' are movable jointly along the length of the stationary framework 12, or along an X-axis, by means of the first servo motor 114 and main ball screw 104. Support surfaces 16, 18 are movable together with respect to each other along the width of the stationary framework, or along a Y-axis, by means of a second drive system defined by the second servo motor 150 and supplementary ball screw arrangement 156. Support surfaces 16', 18' are also movable together with respect to each other along the width of the stationary framework 12, or along a Y-axis, by means of a third drive system defined by the third servo motor 150' and supplementary ball screw arrangement 156'. Second and third drive systems help to establish latitudinal coordinates for the bending and clamping arrangements 30, 32 used in forming a particular sized apron.

As further shown in FIGS. 1–3, the apron-forming apparatus 10 is equipped with back gauge assembly 24 located at the outer end of the stationary framework 12, and a pair of push rod assemblies 26, 28 positioned at the outer end of the movable frame 14. It is the purpose of the back gauge assembly 24 and push rod assemblies 26, 28 to properly position the apron segments 20, 22 along the phantom line paths 35, 35' illustrated in FIGS. 1 and 2 prior to any bending or joining of the segments. With additional reference to FIGS. 9 and 10, back gauge assembly 24 includes a bracket 216 having a pair of parallel side plates 218, 220 connected along the respective top portions by a horizontal mounting plate 222 provided with an upstanding mounting wall 224. Side plates 218, 220 are secured at respective bottom portions, such as by welding, to opposite sides of vertical frame member 130. Welded to the upper portion of mounting plate 222 is a U-shaped slide 226 having a horizontal bottom wall 228, a pair of vertical side walls 230, 232 and a vertical back wall 233. A pair of spaced apart, parallel side guide rails 234, 236 having flat base sections 238 and key-shaped upper portions 240 are secured to the bottom wall 228. The guide rails 234, 236 are matingly received in keyhole-shaped openings 242 formed in a set of inner and outer slide brackets 244, 246 depending downwardly from opposite ends of a slide plate 248. The slide plate 248 forms the lower end of an L-shaped arm 250 having a vertically extending portion 252 and a horizontal inwardly extending portion 254 which lies slightly above the plane of the support surfaces 16, 18. A cross bar 256 having a pair of apron segment engaging pads 258, 260 disposed on opposite ends thereof is secured at a right angle to the end of the horizontally extending arm portion 254. Anchored to the bottom of the slide plate 248 is a ball nut 262 which is threadably engaged with a ball screw 264 running parallel to and between the guide rails 234, 236. The innermost end of the ball screw 264 is supported for rotation in bearing blocks 266 secured on the bottom wall 228 of slide 226. The outermost end of the ball screw 264 passes through the back wall 233 on slide 226 and is joined by a coupling 268 to the output shaft of a fourth servo motor 272 fixed to the upstanding mounting wall 224 of mounting plate 222. Actuation of the fourth servo motor 272 will rotate ball screw 264 such that the L-shaped arm 250, cross bar 256 and apron segment engaging pads 258, 260 can be moved back and forth together in a longitudinal direction represented by the arrows in FIG. 9 to the dotted line position shown therein which extends over the outermost, fixed end of the first fastening system 34.

The push rod assemblies 26, 28 are illustrated in FIGS. 1–3 at the outer end of the apron forming apparatus 10 opposite the back gauge assembly 24. Each of the push rod assemblies 26, 28 includes an L-shaped support bracket 274, 276, respectively, which is affixed to the outermost end of each support surface 16', 18' along with a respective outwardly extending three sided guard 278, 280. Each support bracket 274, 276 maintains a housing 282, 284, respectively, having fixed thereto a respective rod-like linear displacement transducer 286, 288 which extends over a respective support surface 16', 18'. Each housing 282, 284 is connected to a source of pneumatic pressure and together with its respective transducer 286, 288 is typically provided as a one-piece assembly, Transducers 286, 288 are used to measure the length of unbent apron half segments 22 and allow the apparatus 10 to adjust its length and width position to make a "best fit" assembly based on imperfect aprons. Each support bracket 274, 276 also maintains a pneumatic cylinder 290, 292, respectively, which lies parallel to transducer 286, 288. respectively and is pneumatically connected with the respective housing 282, 284. The pair of cylinders 290, 292 have respective movable piston rods 291, 293 provided to pusher faces 294, 296 which lie perpendicular to the rods 291, 293 and are engageable with the ends of apron half segments 22. A pair of movable links 298, 300, respectively, is slidably mounted on transducers 286, 288 and fixedly attached to the rods 291, 293 of cylinders 290, 292. The links 298, 300 join the transducers 286, 288 with the rods 291, 293 respectively, so that according to pneumatic pressure in housings 282, 284, the rods 291, 293 and the pusher faces 294, 296 are selectively extended and retracted along a path parallel to the transducers 286, 288.

Referring to FIGS. 11–19, support surface 18 provides a mounting platform for the clamping arrangement 30, the bending arrangement 32 and an end portion of the elongated apron half segment 22. As seen in dotted lines of FIG. 11, apron half segment 22 is disposed along a path 35' parallel to the longitudinal axis 38 of the stationary framework 12 between the clamping arrangement 30 and the bending arrangement 32. With further reference to the dotted lines of FIG. 12, apron half segment 22 is preferably C-shaped in cross-section, and is comprised of an upper horizontal wall 302 and a lower horizontal wall 304 connected at generally right angles to a vertical wall 306. As will be more fully described later, the particular cross-sectional construction of each apron half segment 20, 22 enables bent end portions thereof to be interrelated in such a manner as to be quickly and positively fastened together to complete an apron assembly.

The description above and to follow applies equally to each of the other three support surfaces 16, 16', 18' as well as the other apron half segment 20, and again corresponding elements in the drawings will be identified by like reference numerals.

Clamping arrangement 30 and bending arrangement 32 cooperate together in bending one end of the apron half segment 20, 22 through a 90° arc. Clamping arrangement 30 is generally comprised of a hydraulic clamping cylinder 308, an anvil assembly 310, and a clamping block 312, all of which are located on the top side of the support surface 18. Clamping arrangement 30 includes a C-shaped mounting bracket 314 (seen also in FIG. 3) for pivotally mounting a casing end 316 of the hydraulic clamping cylinder 308 to a short extension 318 of support surface 18. A rod end 320 of the cylinder 308 is rotatably attached to a mounting ear 322 rigidly fastened in one corner of the anvil assembly 310. As shown in FIGS. 11 and 12, the anvil assembly 310 is defined by a stationary anvil 324 fixedly attached to the support surface 18 such as by fasteners 325 (one of which is seen in FIG. 12). Stationary anvil 324 is generally rectangular in shape and includes an outer periphery having a first straight surface 326 located along the guide path 35' of the elongated apron half segment 22. A second surface 328 extends at an angle slightly less than 90° with respect to the first surface 326 and is joined by a rounded corner 330 having a contour about which the apron segment 22 is bent. As will be appreciated, the contour of the second surface 328 allows for a slight overbend of the end portions of the apron half segments 20, 22 which is necessary to compensate for the elasticity of the metallic segments. The outer periphery of the stationary anvil 324 is formed with an inwardly extending U-shaped channel 332 formed by a lower lip 334 and an upper lip 336. Lower lip 334 rests upon the support surface 18, and upper lip 336 defines a shallow niche 338 for supporting the lower horizontal wall 304 of the apron half segment 22. An upper surface of the stationary anvil 324 is formed with a stepped cavity 340 in the vicinity of the rounded corner 330 for accommodating a headed pivot pin 342 (FIGS. 15 and 18) which depends downwardly through the support surface 18. The upper surface of the stationary anvil 324 is further provided with a pair of trapezoidally-shaped outer gibs 344 having inner bearing surfaces in sliding relationship with a pair of offset inner gibs 346. Fasteners 348 secure inner gibs 346 to a bottom surface of a clamping anvil 350 which overlies the stationary anvil 324 and slides with respect thereto.

Figure 14:
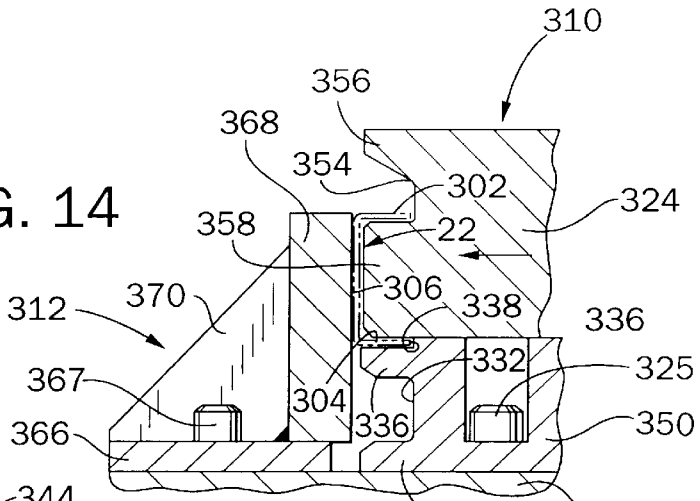
FIG. 14 is a cross-sectional view taken on line 14—14 of FIG. 13.
Figure 13:
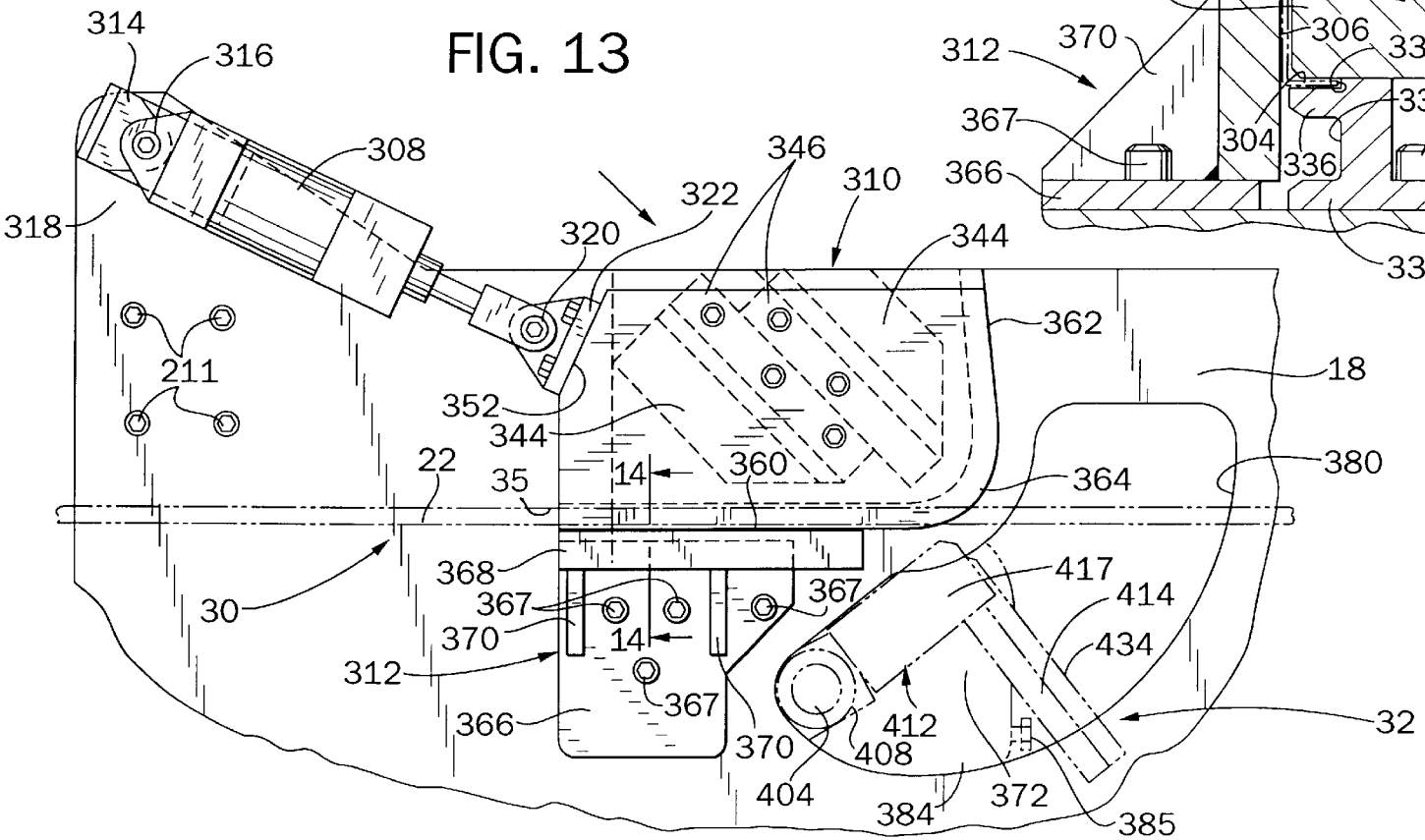
FIG. 13 is a fragmentary plan view similar to FIG. 11 but showing the apron half segment in a clamped position.

Clamping anvil 350 is provided with a beveled corner 352 to which the clamping cylinder rod end 320 is movably fastened. Similar to stationary anvil 324, the outer periphery of clamping anvil 350 is formed with an inwardly extending pocket 354 which is formed by an upper band 356 and a lower band 358 slidable into and out of the interior of the C-shaped apron half segment 22. That is, the cross section of the lower band 358 is shaped to fill the interior of the apron segment 22 and provide a conforming fit therewith. The pocket 354 has a contour which will snugly receive a bending component to be described hereafter. Also, the outer periphery of the clamping anvil 350 has a first surface 360, a second surface 362 shaped like stationary anvil second surface 328, and a rounded corner 364 which, in a retracted position shown in FIGS. 11 and 12, are held spaced from corresponding surfaces 326, 328 and round corner 330 on stationary anvil 324. Because of the sliding relationship between stationary anvil 324 and clamping anvil 350, surfaces 326, 360 and 328, 362 and rounded corners 330, 364 are alignable with each other as shown in FIGS. 13 and 14.

Clamping block 312 is anchored to the support surface 18 on the opposite side of the guide path 35' for the apron half segment 22 across from the anvil assembly 310. Defining an L-shaped cross section of the clamping block 312 is a horizontal leg 366 fastened to the support surface 18 by bolt and nut fasteners 367, a vertical leg 368 welded perpendicularly to the horizontal leg 366 and a pair of small triangular gussets 370 extending between the horizontal and vertical legs. As shown in FIGS. 12 and 14, an upper, outer face of the vertical leg 368 is constantly engageable with the exterior of vertical wall 306 of the apron half segment 22 just as the niche 338 in the stationary anvil 324 constantly provides a seat for the lower horizontal wall 304 of the apron half segment 22. In FIG. 12, with the clamping cylinder rod 320 in a retracted, unclamped position, the outer peripheries of the clamping anvil 350 and the stationary anvil 324 are offset from one another. In FIG. 14 with the clamping cylinder rod 320 in a slightly extended clamping position, the clamping anvil 350 will slide in the direction of the arrow upon the stationary anvil 324, such that the surfaces 326, 360 and 328, 362 and rounded corners 330, 364 will become aligned with one another. During this movement, the lower band 358 of clamping anvil 350 slides into conforming relationship with the interior surfaces of the C-shaped apron half segment 22 to firmly clamp vertical wall 306 between clamping block vertical leg 368 and clamping anvil lower band 358. Simultaneously, the lower horizontal wall 304 of apron half segment 22 is clamped in the niche 338 between the clamping anvil lower band 358 and the stationary anvil upper lip 336.

Figure 18:
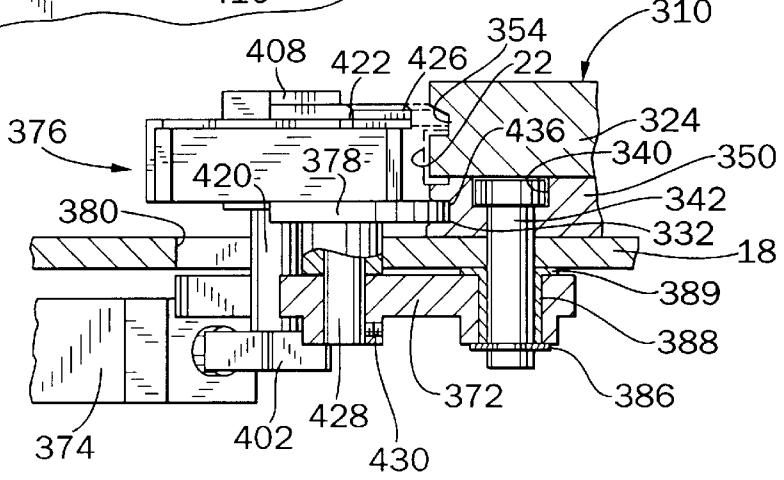
FIG. 18 is a cross-sectional view taken on line 18—18 of FIG. 15.
Figure 19:
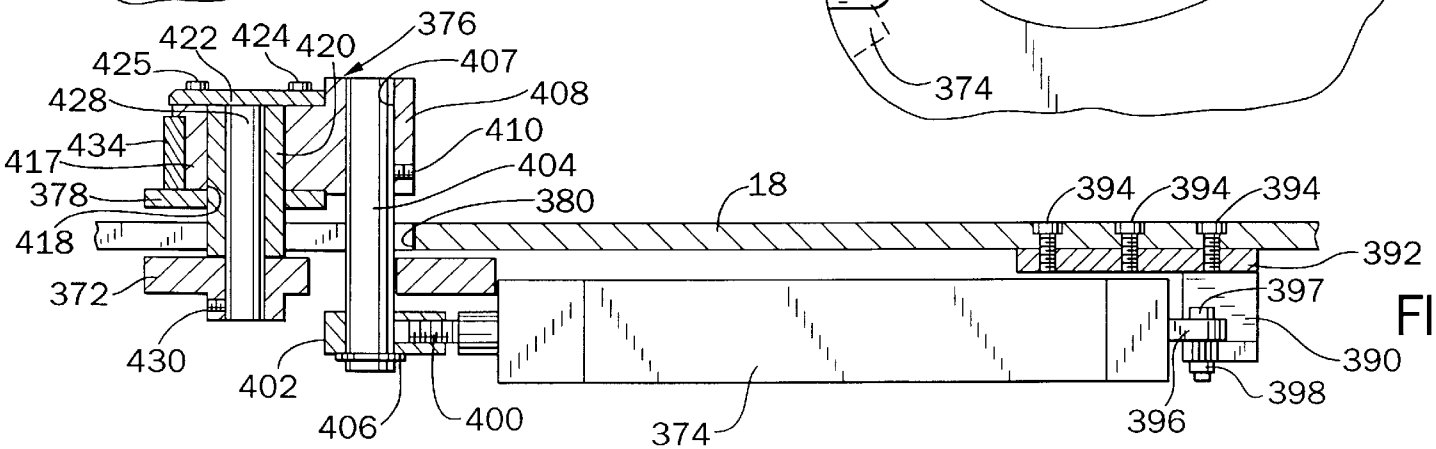
FIG. 19 is a cross-sectional view taken on line 19—19 of FIG. 15.
Figure 20:
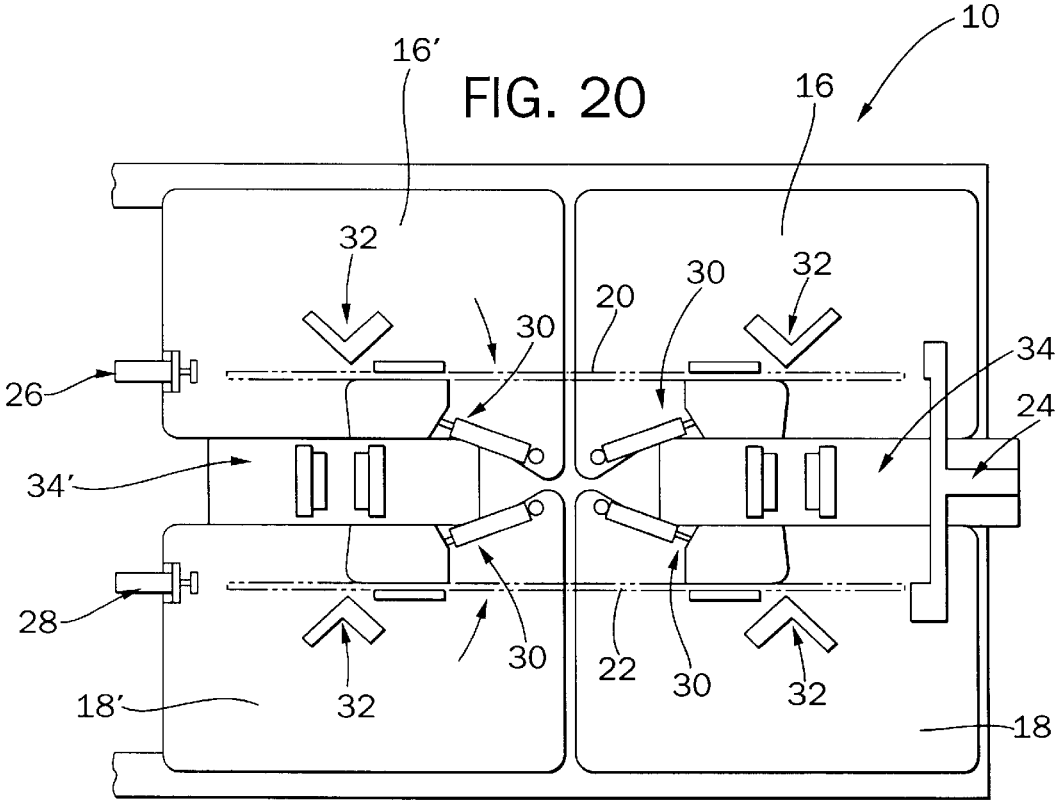
Figure 21:
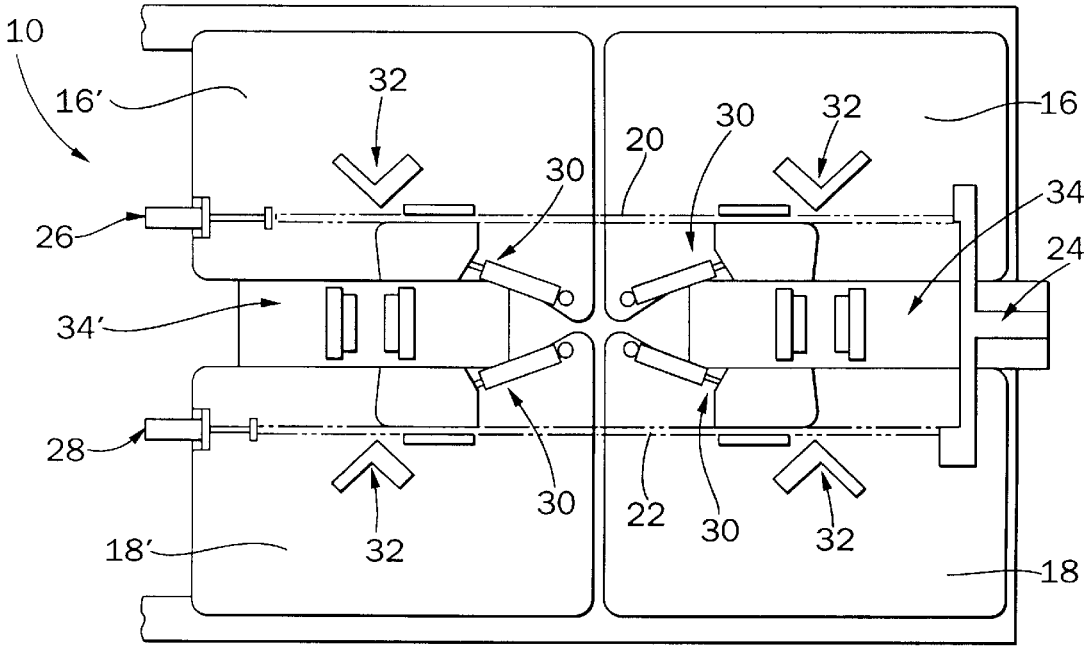

Referring now to FIGS. 15–19, bending arrangement 32 is primarily comprised of a bend arm 372, a bending cylinder 374, a form bar 376 and a cam plate 378. Of these bending components, form bar 376 and cam plate 378 are disposed above the support surface 18, while bending cylinder 374 and bend arm 372 are positioned beneath the support surface 18. As will be detailed below, certain components of the bending arrangement 32 extend through and swing within a large arcuate slot 380 formed in the support surface 18. Bend arm 372 is a wishbone-shaped element having spaced first and second fingers 382, 384 respectively. An adjusting screw 385 is threaded through finger 384, its shaft end determining the position at which bending of the apron half segment will begin. As seen in FIG. 18, bend arm 372 is supported by a retaining ring 386 for pivoting movement about the headed pin 342 depending downwardly from stationary anvil 324 through and below support surface 18. A bearing sleeve 388 is interposed between the bend arm 372 and the pin 342, and includes a radially enlarged upper portion 389 which maintains space between an upper face of the bend arm 372 and a lower face of the support surface 18. As seen in FIG. 19, bending arrangement 32 includes a mounting hanger 390 suspended from support surface 18 by a horizontal mounting plate 392 secured to the support surface 18 by fasteners 394. Bending cylinder 374 has a casing end 396 pivotally attached to the mounting hanger 390 by a bolt 397 and nut 398. Bending cylinder 374 also has a rod end 400 which is screw threaded into a suitable threaded opening on a rocker arm 402 swingably mounted to the bottom end of a first cylindrical pivot pin 404 and held thereon by a second retaining ring 406. First pivot pin 404 extends upwardly through the arcuate slot 380 and terminates above support surface 18 in an upper end which is received in a cylindrical bore 407 formed in a raised portion 408 of the form bar 376 and is fixed thereto by a first set screw 410.

Form bar 376 is an L-shaped construction having a first leg 412, a second leg 414 joined at a right angle to the first leg 412, and a horizontally extending triangular brace 416 interconnecting the legs. First leg 412 includes the raised portion 408 at a distal end thereof, and a block portion 417 at a proximal end thereof. Block portion 417 is formed with a second cylindrical bore 418 (FIG. 19) which receives a bearing sleeve 420 having a bottom end supported on an upper face of bend arm 372, and an upper end engageable against the bottom of a rectangular attachment plate 422 secured to block portion 417 by fasteners 424. Attachment plate 422 has an outwardly extending edge 426 configured to fit into the pocket 354 formed on clamping anvil 350. A second cylindrical pivot pin 428 has a bottom end supported in bend arm 372 by a second set screw 430. Second pivot pin 428 extends upwardly through slot 380 and terminates beneath attachment plate 422. Bearing sleeve 420 surrounds the second pivot pin 428 filling the second cylindrical bore 418, and is maintained in position by the bottom of the attachment plate 422 and the top of bend arm 372. Second leg 414 is an essentially rectangular bar having an outwardly facing surface provided with a wear strip 434 along the entire length thereof. Bar 414 and wear strip 434 are formed with a larger width than the width of the apron half segment 22 against which the wear strip 434 is engaged during bending. Bar 414 and wear strip 434 are also designed with a suitable length which corresponds to a desired length of apron half segment 22 to be bent. Cam plate 378 is a generally rectangular plate which is secured directly to the bottom of the form bar 376 and includes a curved camming edge 436 (FIGS. 18 and 19) which is constantly lodged in channel 332 formed in the stationary anvil 324.

Figure 15:
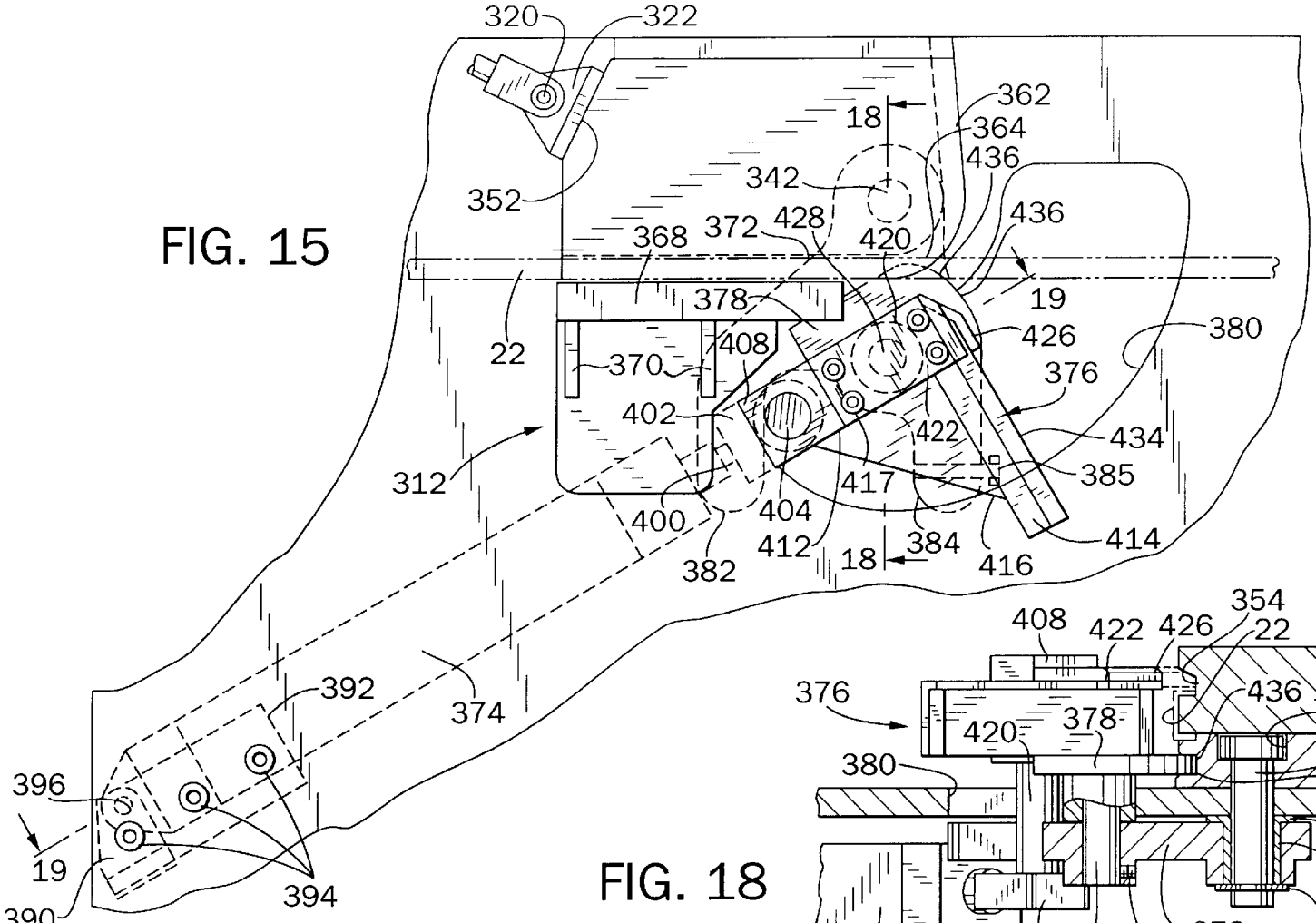
FIG. 15 is a fragmentary plan view similar to FIG. 13 showing a bending arrangement for moving the bending components into and out of engagement with the apron half segment.
Figure 17:
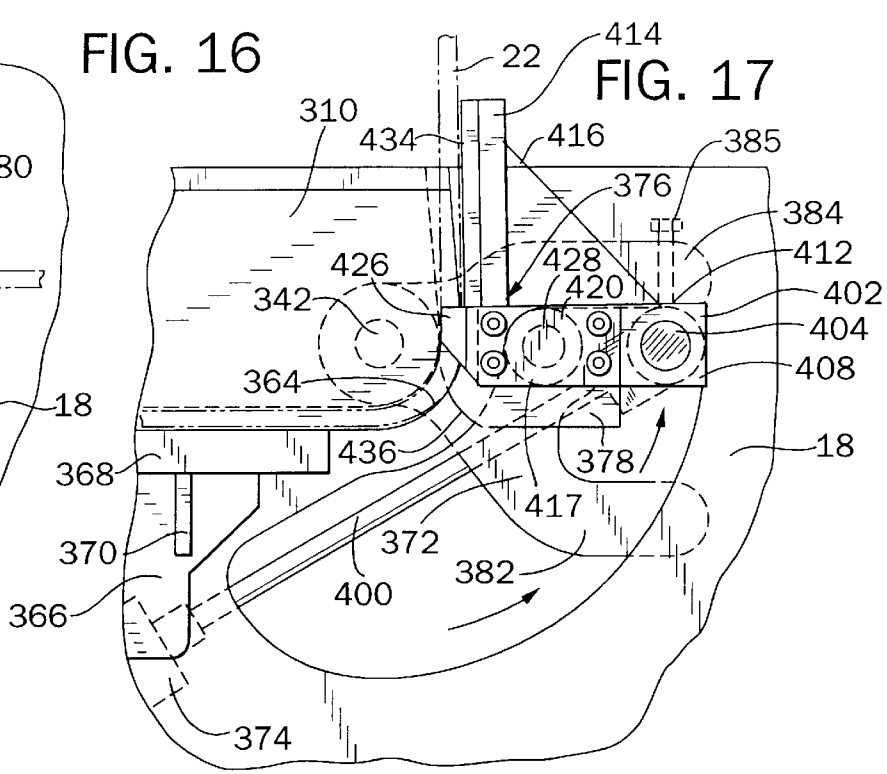
FIGS. 16 and 17 are fragmentary, plan views similar to FIG. 15 showing sequential movement of the bending arrangement to effect bending of the apron half segment.

With the bending cylinder 374 in a retracted position shown in FIG. 15, each apron half segment 22 is loaded and placed in a clamped condition as described above. In this position, form bar 376 is oriented such that the longitudinal axis of bending cylinder 374 lies substantially parallel to the longitudinal axis of first leg 412, and the wear strip 434 on the second leg 414 lies approximately 60° from the apron half segment 22. In addition, the first pivot pin 404 lies against an inner surface of the first finger 382 on bend arm 372. The shaft end of adjusting screw 385 is flush with the inside surface of finger 384. As bending cylinder 374 is slightly extended, form bar 376 will swing in the direction of the arrow in FIG. 16 about first and second pivot pins 404, 428 which move along the slot 380 in support surface 18. With this motion, the longitudinal axis of the first leg 412 is at a generally right angle to apron half segment 22, and wear strip 434 on second leg 414 is positioned against the vertical wall 306 of apron half segment 22. First pivot pin 404 now lies against the inner surface of the second finger 384 on bend arm 372. With further extension of bending cylinder rod 400, as shown in FIG. 17, form bar 376 will continue to swing along an arcuate path dictated by the camming edge 436 of cam plate 378 which rides in the channel 332 of stationary anvil 324. In addition, bend arm 372 is pushed by the first pivot pin 404 and is swung about second pivot pin 428 in the direction of the arrows of FIG. 17. During this movement, bending cylinder 374 will transmit a bending force through the first pivot pin 404 such that the second leg 414 of form bar 376 will bend an end portion of the apron half segment 22 around the rounded corner contour of the anvil assembly 310 at a 90° arc. Before reaching the position of FIG. 17, the second leg 414 of form bar 376 will slightly overbend the end portion of apron half segment 22 along the aligned second surfaces 328, 362 of the anvil assembly 310 so as to compensate for the elasticity of the metallic segment.

Figure 16:
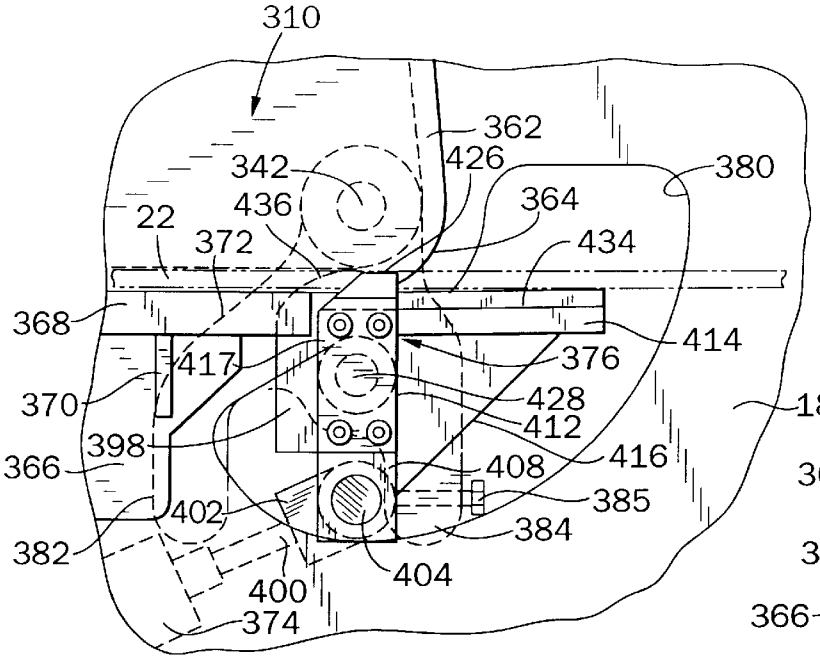

As the form bar 376 swings from the position shown in FIG. 16 to the position shown in FIG. 17, it is important to understand that the edge 426 of the attachment plate 422 is snugly received in the clamping anvil pocket 354 over the outer surface of the upper horizontal wall 302 of the apron half segment 22. The combination of the camming edge 436 riding in the channel 332 and the attachment plate edge 426 sliding into the pocket 354 defines an anti-buckling assembly which controls wrinkling or buckling of the bent portion of the apron half segment 22. Also contributing to the control of wrinkling is the clamping engagement of the apron half segment 22 provided by the clamping arrangement 30 discussed above.

Although the shaft end of the adjusting screw 385 is shown flush with the inner surface of finger 384, it should be appreciated that screw 385 is easily turned to extend the shaft beyond the inner surface of finger 384 for engagement with pivot pin 404 so as to control the position at which bending occurs. It has been found that the adjustment of screw 385 helps control the direction of wrinkling of the lower horizontal wall 304 of apron half segment 22 during forming of the apron.

The clamping arrangement 30 and bending arrangement 32 are utilized to bend an end portion of the apron half segment 20 or 22 on each of the four coplanar support surfaces 16, 16', 18, 18'. In accordance with the invention, the end portions of the apron half segments 20, 22 are bent into an overlapping relationship on the support surfaces 16, 16', 18, 18' and are joined together by the first fastening system 34 on stationary frame 12 and the second fastening system 34' on movable frame 14.

With reference to FIGS. 3, 9 and 25–28, first fastening system 34 is mounted on the first support girder 52 between support surfaces 16, 18 and comprises a pair of vertically extending cylindrical guide bars 438, 440, a horizontal base plate 442, a hydraulic lift cylinder 444 having a movable rod 445, a pair of spaced, movable cross bars 446, a pair of spaced vertical side plates 448, 449 and a pair of fastening dies 450, 452. In the drawings, only one of the cross bars 446 is shown. Guide bars 438, 440 have bottom ends which are firmly secured in the lower cylindrical collars 56, 58 on first support girder 52. Midportions of the guide bars 438, 440 are supported by a pair of horizontal braces 454, 456, one being attached to the vertical frame member 130 and the other being secured to stationary servo post 132. Base plate 442 interconnects the upper ends of guide bars 438, 440 and includes a pair of spaced, upper cylindrical collars 458, 460. Each side of the base plate 442 carries one of the vertical side plates 448 which is mounted for movement with the base plate 442. The top ends of guide bars 438, 440 pass through upper cylindrical collars 458, 460 on the base plate 442 and have externally threaded ends upon which a pair of nuts 462, 464 are fastened. A pair of movable end pads 466, 468 are connected to opposite ends of each cross bar 446 for support on rod 445. In the preferred embodiment, end pads 466, 468 are also supported on braces 454, 456. A pair of heavy duty coil springs 470, 472 surround the upper portion of guide bars 438, 440 between the upper cylindrical collars 458, 460 and the end pads 466, 468.

Hydraulic lift cylinder 444 has a casing end 474 secured on the support plate 54 of the first support girder 52 and a rod end 476 which is attached to the tops of the movable cross bars 446. Each of the fastening dies 450, 452 is movably mounted with respect to the base plate 442 and normally disposed on each side of the apron half segments 20, 22. The fastening dies 450, 452 are slidable along a pair of parallel die rods 478 which are mounted along the length of the base plate 442 and carry coil springs 480 between the fastening dies 450, 452 that normally bias the fastening dies. In the drawings, only one of the die rods 478 (FIGS. 9, 26 and 27) and coil springs 480 is illustrated. As is well known, the fastening dies 450, 452 are provided with a variety of punches (not shown) which are forcibly engageable with opposed sides of the bent and juxtaposed end portions of the apron segments 20, 22 to clinch the end portions together without employing separate fastening elements. Acting on the back side of each fastening die 450, 452 is a roller 482, 483 which is supported between the upper ends of a pair of parallel bell cranks 484, 486. The middle of each bell crank 484, 486 is pivotally attached in a bearing block 488, 490 disposed on the horizontal base plate 442. The lower ends of the bell cranks 484, 486 are connected by cross pins 492, 494 extending across the vertical side plates 448. A pair of movable links 496, 498 are connected between the cross pins 492, 494 and the lift cylinder rod end 476. Collectively, fastening dies 450, 452, rollers 482, 483, bell cranks 484, 486 and other components as described above which are supported above cross bars 446 form a clinch-making assembly for joining the overlapped ends of apron half segments 22.

Figure 25:
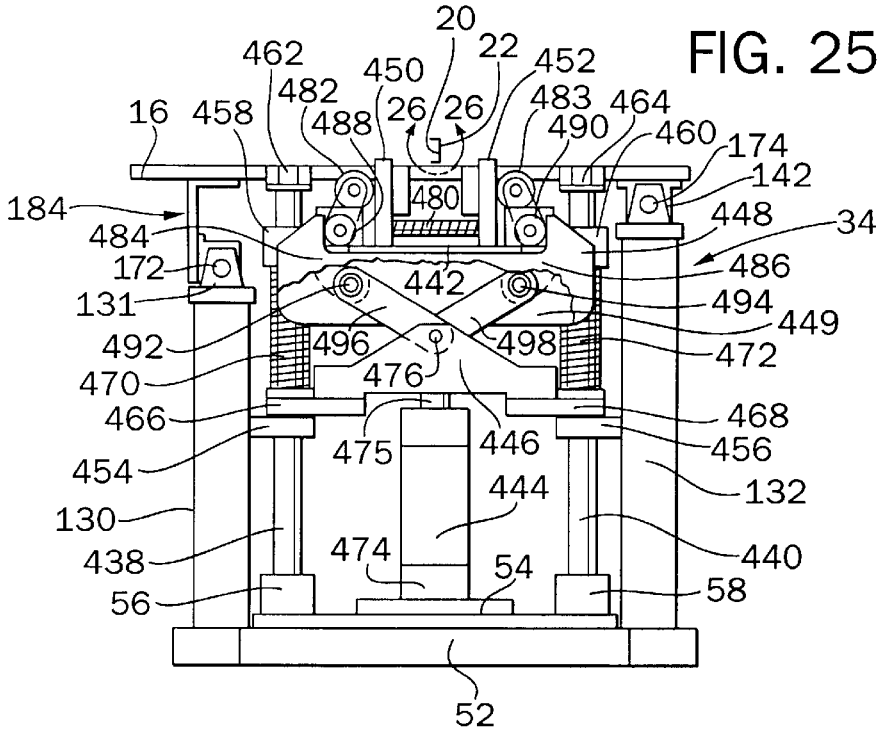
FIG. 25 is a cross-sectional view taken on line 25—25 of FIG. 24 showing a system for fastening nested male and female end portions of apron half segments following bending thereof.

With the first fastening system 34 as shown in the position of FIG. 25, the ends of the C-shaped apron half segments 20, 22 have been bent and are positioned in a common plane upon the support surfaces 16, 18 in a juxtaposed and, more specifically, overlapping condition seen in FIG. 26. Each apron segment 20, 22 has a male end having a projecting tongue 21 which is received in a female end defined by the cooperating end of the other segment. First fastening system 34 is in a rest condition in which the fastening dies 450, 452 are spaced away from the apron segments 20, 22 and held down below the support surfaces 16, 18. In the rest position, the springs 470, 472 support the entire load of the fastening dies 450, 453, the rollers 482, 483, the bell cranks 484, 486 and the entire clinch-making assembly. The springs 470, 472 are sized such that the weight of this assembly does not appreciably deflect them.

When it is desired to permanently join the overlapped end portions of the apron segments 20, 22, the lift cylinder 444 is actuated (FIG. 27) to extend the rod 445 so that the cross bars 446 move upwardly. The springs 470, 472 start to compress only when the rising assembly contacts the nuts 462, 464 on the ends of the guide bars 438, 440. The springs 470, 472 do not start to compress until the clinch-making assembly rises to the proper height so that the fastening dies 450, 452 do not close prematurely before reaching the proper location on the overlapped apron segments 22. The fastening dies 450, 452 remain open to their farthest extremes so that there is no interference with the apron as the assembly is rising. As the cross bars 446 move upwardly, the links 496, 498 move downwardly and outwardly, as shown by the arrows in FIG. 27, and force the base plate 442 and vertical side plates 448 upwardly. This initial vertical motion will eventually cause the fastening dies 450, 452 on base plate 442 to rise upwardly above the common plane of the support surfaces 16, 18 in the space between the support surfaces. Continued extension of lift cylinder rod 476, as shown in FIG. 28, will move the bell cranks 484, 486 over center imparting an inward pushing force to each of the rollers 482, 483. Such inwardly directed force overcomes the outwardly directed biasing influence of the coil springs 480 and pushes the fastening dies 450, 452 towards each other, as shown by the horizontal arrows, so as to clinch the overlapped end portions together. The type of joining or clinch-making accomplished by dies 450, 452 is commonly known as TOX® fastening.

Once the end portions of the apron segments 20, 22 have been joined, the lift cylinder 444 is retracted, the fastening dies 450, 452 being returned to their original position by horizontal springs 480 on the die rods 478 and vertical springs 470, 472 between the end pads 466, 468 and the base plate 442. However, it is important to appreciate that the clinch-making assembly does not simply just drop away as the hydraulic cylinder 444 descends.

After the fastening dies 450, 452 are completely closed, and the TOX joint is complete, the hydraulic cylinder 444 is actuated downward. The large, compressed springs 470, 472 keep the clinching assembly tight to the guide rod nuts 462, 464 while allowing the cross bars 446 to descend. This motion causes the linkage system to open up the fastening dies 450, 452. Upon further descent of the hydraulic cylinder 444, when the fastening dies 450, 452 are completely open, the entire clinch-making assembly will drop below the apron support surfaces 16, 18. The fastening dies 450, 452 are designed to open completely before the assembly starts to descend so that the apron will not be dragged with it and ruined. Thus, the fastening dies 450, 452 move upwardly and downwardly along a Z-axis perpendicular to the common plan of the support surfaces in which the X and Y axes lie. The fastening dies 450, 452 return to their original position shown in FIG. 25, and the apron forming apparatus 10 is ready for another bending operation after the apron is removed from the forming apparatus.

It should be understood that the above description of the first fastening system 34 is equally applicable to the second fastening system 34' located on the movable frame 14. Both fastening systems 34, 34' are operated simultaneously following bending and juxtapositioning of the bent apron segment end portions to complete a finished apron.

Although it does not form part of the invention, it should also be understood that the overall operation of the apron forming apparatus 10 is automatically controlled by a programmable logic controller (PLC) which makes a determination as to the sequence of aligning, clamping, bending and end fastening to be performed according to the dimensions of the desired apron. The method and apparatus are programmed to regulate the timing and pressure of the clamping, bending and fastening components in a manner which will require minimum operator intervention during formation of each apron.

Before the placement of any apron segments 20, 22 on the apron forming apparatus 10, the PLC is programmed with the range of desired apron sizes to be produced. One set up-for a rectangular apron of maximum size, say 30 inches by 96 inches, is represented in FIG. 1 wherein the first servo motor 114 is used to separate the support surfaces 16', 18' as far away as possible from the support surfaces 16, 18 along the length of stationary framework 12 or the X-axis. Second servo motor 150 is employed to move support surfaces 16, 18 as far away as possible from the longitudinal axis of the stationary framework 12 along the width of the stationary framework 12 or along a Y-axis. Third servo motor 150' is simultaneously operated with second servo motor 150 to move support surfaces 16', 18' to corresponding positions of support surfaces 16, 18 along the Y-axis. Throughout the initial positioning of the support surfaces 16, 18, 16', 18', the clamping and bending arrangements 30, 32 are maintained in non-clamping and non-bending modes (FIG. 1) and the first and second fastening systems 34, 34' are deactivated such that the fastening dies 450, 452 remain inoperative beneath the support surfaces 16, 18, 16', 18' (FIG. 3).

At any time, when apron segments 20, 22 are not in position across support surfaces 16, 18, 16', 18', the PLC will automatically pre-adjust the apron forming apparatus 10 to a desired rectangular size. FIG. 2 illustrates an adaptation for a rectangular frame of minimum size, say 24 inches by 48 inches. In this case, the first servo motor 114 is implemented to move the support 16', 18' as close together as possible along the X-axis. Similarly, the second and third servo motors 150, 150' are actuated to draw support surfaces 16, 18, 16', 18' as close together along a Y-axis. It is noted that the supplementary ball screw arrangements 156, 156' are designed so as to define a stop limit for the inward movement of the support surfaces 16, 18 and 16', 18' along the Y-axis such that there is no portion of the support surfaces 16, 18 and 16', 18' obstructing the movable components of the first and second fastening systems 34, 34'. Fourth servo motor 272 may also be activated to move the engaging pads 258, 260 on back gauge assembly 24 inwardly so as to compensate for the shorter length of the apron half segments 20, 22. Because of their mounting on respective support surfaces 16, 18, 16', 18', each clamping arrangement 30 and bending arrangement 32 may be positioned at a particular coordinate along the X and Y axes which will generally correspond to a corner of the rectangular apron.

FIGS. 20–24 are diagrammatic plan views representing sequential operation of the apron forming apparatus 10 upon a pair of elongated apron half segments 20, 22 of C-shaped cross section used to form an apron of the size corresponding to the setup of FIG. 2. Each of the apron half segments 20, 22 are cut to a predetermined length in a cutting machine (not shown) separate from the apron forming apparatus 10 and formed with a male end of one C-shaped cross section having the projecting tongue 21, and a female end of a larger, similar C-shaped cross section for receiving the male, tongued end. An automatic loading/unloading machine (not shown) is programmed to place apron half segments 20 on support surfaces 16', 16 between anvil assemblies 310 and the clamping block vertical leg 368 with the male tongued end spaced from engaging pad 258 on back gauge assembly 24 and female end spaced from pusher face 294 on push rod assembly 26. The other apron half segment 22 is placed between anvil assemblies 310 and the clamping block vertical leg 368 with female end spaced from the engaging pad 260 on back gauge assembly 24 and male end spaced from the pusher face 296 on push rod assembly 28. Each of the apron half segments 20, 22 lie parallel to each other as well as parallel to the longitudinal axis 38 of the stationary framework 12. In addition, each of the apron half segments 20, 22 lies in the common plane of the four support surfaces 16, 18, 16', 18'.

Once the apron half segments 20, 22 have been initially positioned on the support surfaces 16, 18, 16', 18', sensing devices in the control system will activate the push rod assemblies 26, 28 to push the apron half segments 20, 22 against the engaging pads 258, 260 on back gauge assembly 24. After pushing the apron half segments 20, 22 against the engagement pads 258, 260, the push rod assemblies 26, 28 are retracted. Although not shown, the movable links 298, 300 mounted on the push rod assemblies 26, 28 each carry a magnetic based transducer which sends a signal to the PLC during movement of the push rod assemblies 26, 28. Such signal is compared against a predetermined value and if there is a deviation, the back gauge assembly 24 can be utilized to properly reposition the apron half segments 20, 22.

Figure 24:
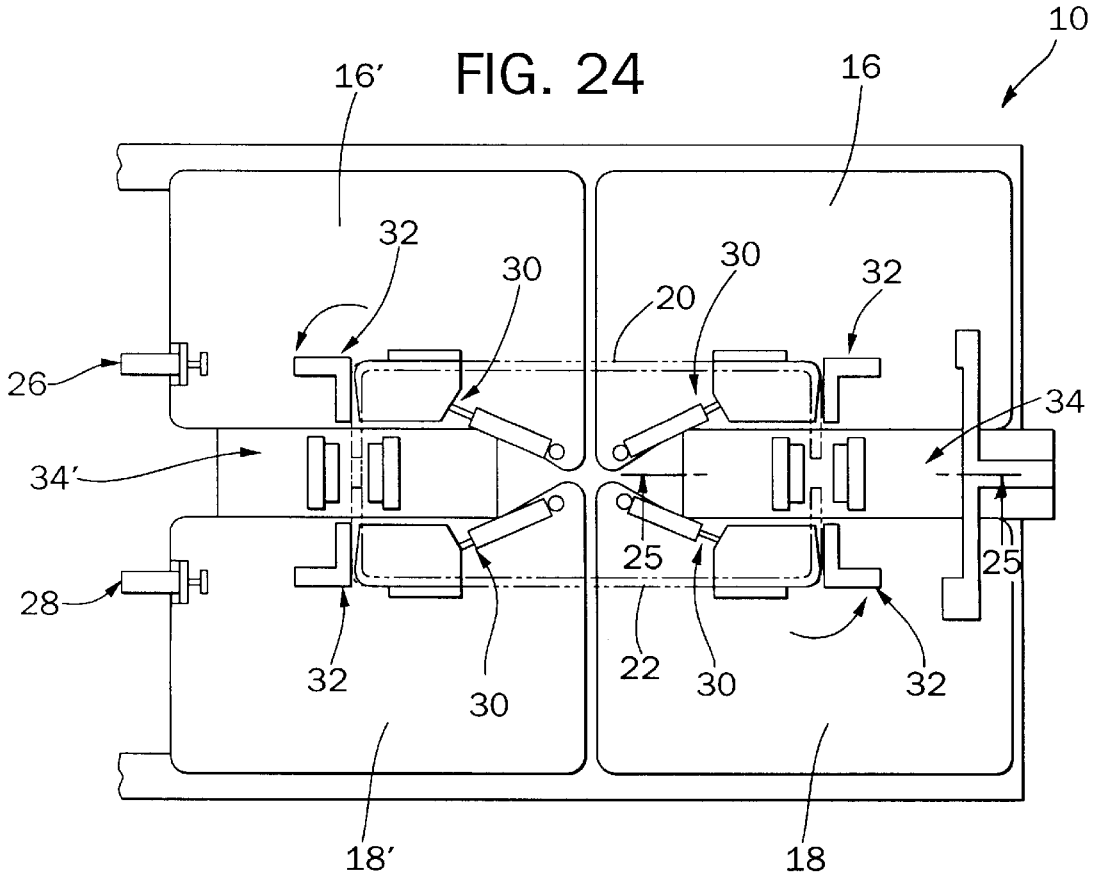

With the accepted positioning of the apron half segments 20, 22, each of the clamping cylinder rods are extended to clamp the segments 20, 22 between clamp block vertical leg 368 and the anvil assembly 310 on each support surface 16, 18, 16', 18' as shown in FIGS. 14 and 22. Then, as seen in FIG. 23, the bending arrangements 32 on diagonally opposed support surfaces 16, 18' are activated to swing form bars 376 into bending engagement with the male, tongued ends of the apron half segments 20, 22. The form bars 376 are returned to their original position and the male, tongued ends of the bent apron half segments 20, 22 are located between the fastening dies 450, 452 which lie beneath the common plane of the support surfaces. Next, as shown in FIG. 24, the bending arrangements 32 on the other pair of diagonally opposed support surfaces 16', 18 are actuated to swing form bars 376 into bending engagement with the female ends of the apron half segments 20, 22. Form bars 376 are returned to their original position and the female ends of the bent apron half segments 20, 22 are placed in overlapping relationship with the male, tongued ends between the fastening dies 450, 452.

After the clamping and bending operations have taken place, the lift cylinders 444 of the first and second fastening systems 34, 34' are energized to move the fastening dies 450, 452 on either side of the respective nested bent end portions upwardly above the support surfaces 16, 18, 16', 18' (FIG. 26) and into clinching engagement with apron half segments 20, 22 (FIG. 27), such that the segments are permanently joined while lying on the support surfaces 16, 18, 16', 18' without the need for independent fasteners. Following joining of the apron half segments 20, 22, the lift cylinders 444 are retracted so that the fastening dies 450, 452 may be returned to their original position shown in FIG. 25. Aligning, clamping, bending and joining the apron half segments 20, 22 as described above, will result in a completely finished apron which remains clamped by the clamping arrangement 30 until the automatic loading/unloading machine is positioned over the support surfaces 16, 18, 16', 18' carrying another pair of apron half segments 20, 22. Then, the clamping cylinders 308 are retracted to release the finished apron support structure on the support surfaces 16, 18, 16', 18' such that the loading/unloading machine will grab the finished apron and replace it with the unbent segments 20, 22. The finished apron is transferred to an associated work area, such as a conveyor, where the completed apron is fastened to the underside of the table top.

In the preferred embodiment, it is noted that the apron half segments 20, 22 of C-shaped cross section are particularly desirable because they present a lower horizontal wall 304 adapted to be secured easily to the tabletop. However, it should be appreciated that other overlapping arrangements using different cross sections may also be used. Likewise, other types of fastening systems may also be employed to join these variously cross sectioned apron segments. It should also be mentioned that the invention further contemplates the use of non-metallic apron half segments which could be clamped, bent and joined with the addition of a selective heat applying device. In lieu of the bending cylinders 374, the invention may also be realized by using electric servos.

The apron forming apparatus 10 set forth herein is particularly adept in consistently producing high quality table aprons approximately every 15 seconds in a manner of which eliminates manual bending and handling of any sort by an operator. Unlike prior art devices, a pair of apron half segments 20, 22 are bent into a rectangular apron by a four headed bender and joined in a common plane, on which the segments are supported for bending. Because each of the clamping and bending arrangements 30, 32 is adjustable along X and Y axes, the apron forming apparatus 10 provides a modular system for conveniently producing a wide array of differently sized aprons.

It should be understood that the apron forming apparatus 10 can be modified to use a different shaped die other than that provided by the anvil assembly so that the aprons or frames having a shape other than rectangular may be made.

While the invention has been described with reference to a preferred embodiment, those skilled in the art will appreciate that certain substitutions, alternations and omissions may be made without departing from the spirit thereof. Accordingly, the foregoing description is meant to be exemplary only, and should not be deemed limitative on the scope of the invention set forth with the following claims.

We claim:

1. A frame forming apparatus for bending and joining a pair of frame components, each having a pair of ends, the apparatus comprising:

a series of four frame support surfaces lying in a common plane;

a clamping arrangement mounted on each of the frame support surfaces for selectively clamping a frame component;

a bending arrangement secured to each of the frame support surfaces for selectively bending a frame component;

each of the bending arrangements being movable into engagement with a frame component to bend the frame component about the clamping arrangement such that the ends of one of the bent frame components are placed in overlapping relationship with the ends of the other bent frame components; and a fastening arrangement having at least one pair of spaced apart fastening dies normally disposed beneath the common plane of the frame support surfaces and operable following overlapping of the bent end portions of the frame components to rise above the common plane of the frame support surface and clinch the bent overlapped end portions together.

2. The frame forming apparatus of claim 1, wherein the clamping arrangement includes a hydraulic clamping cylinder having a casing end pivotally mounted to the top side of the frame support surface and a rod end, an anvil assembly movably mounted on the top side of the frame support surface and connected to the clamping cylinder rod end, and a clamping block fixed to the top side of frame support surface and spaced from the anvil assembly, the space between the anvil assembly and the clamping block defining a guide path for the frame component.

3. The frame forming apparatus of claim 2, wherein the anvil assembly includes a stationary anvil fixed to the frame support surface, and a clamping anvil slidably attached to the stationary anvil and connected to the clamping cylinder rod end.

4. The frame forming apparatus of claim 3, wherein the stationary anvil and the clamping anvil each have a first straight surface running along one side of the frame component, a second surface extending at an angle slightly less than 90° with respect to the first surface and a rounded corner connecting the first and second surfaces and defining a 90° arc.

5. The frame forming apparatus of claim 4, wherein the first and second surfaces and the rounded corner of the clamping anvil are alignable with the first and second surfaces and rounded corner of the stationary anvil.

6. The frame forming apparatus of claim 2, wherein the clamping block includes a first leg fixed to each frame support surface and a second leg extending perpendicularly from the first leg and lying along the other side of the frame component.

7. The frame forming apparatus of claim 1, wherein each frame support surface is formed with an arcuate slot.

8. The frame forming apparatus of claim 7, wherein the bending arrangement includes a bending cylinder having a casing end suspended from a bottom side of each frame support surface and a rod end, a rocker arm connected to the rod end, a first pivot pin extending through the slot and having a bottom end swingably mounted to the rocker arm and an upper end, a form bar pivotally mounted to the upper end of the first pivot pin, a second pivot pin extending through the slot and having an upper end pivotally mounted in the form bar and a bottom end, a cam plate secured to a bottom side of the form was and a bend arm attached to the bottom end of the second pivot pin.

9. The frame forming apparatus of claim 8, wherein the form bar is an L-shaped construction having a first leg and a second leg extending perpendicularly to the first leg.

10. The frame forming apparatus of claim 9, wherein the second leg of the form bar is provided with a wear strip engageable with a frame component during bending thereof.

11. The frame forming apparatus of claim 9, wherein the first leg includes a raised portion at a distal end thereof, and a block portion at a proximal end thereof.

12. The frame forming apparatus of claim 11, wherein the first pivot pin is located in the raised portion of the form bar and the second pivot pin is positioned in the block portion of the form bar.

13. An apron forming apparatus for bending and joining a pair of apron half segments, each having a pair of ends, the apparatus comprising:

a series of four apron support surfaces lying in a common plane;

a clamping arrangement mounted on each of the apron support surfaces for selectively clamping an apron half segment;

a bending arrangement secured to each of the apron support surfaces for selectively bending an apron half segment;

each of the apron half segments being disposed between the clamping arrangement and the bending arrangement on a pair of apron support surfaces such that the apron half segments lie substantially parallel to each other;

each of the bending arrangements being movable into engagement with an apron half segment to bend the apron half segment such that the ends of one bent apron half segment are placed in overlapping relationship with the ends of the other bent apron half segment; and a fastening arrangement for joining the overlapped ends of the bent apron half segments while the apron half segments are positioned on the apron support surfaces.

14. The apparatus of claim 13, wherein the clamping arrangement includes an anvil assembly, comprising of a stationary anvil affixed to the apron support surface and a clamping anvil movably mounted on the stationary anvil.

15. The apparatus of claim 14, wherein the stationary anvil includes a peripheral surface provided with an inwardly extending channel formed by an upper lip and a lower lip, the upper lip defining a shallow niche therein.

16. The apparatus of claim 15, wherein the clamping anvil includes a peripheral surface having an inwardly extending pocket formed by an upper band and a lower band.

17. The apparatus of claim 16, wherein the clamping arrangement further includes a clamping block spaced from the anvil assembly, the space between the anvil assembly and the clamping block forming a guide path for positioning an apron half segment.

18. The apparatus of claim 17, wherein each of the apron half segments is C-shaped in cross section and has an upper horizontal wall, a lower horizontal wall, and a vertical wall connected to the upper and lower horizontal walls at a right angle.

19. The apparatus of claim 16, wherein the bending arrangement includes a form bar pivotally mounted an each of the apron support surfaces, the form bar carrying an attachment plate having an edge movable into and out of the inwardly extending pocket on the clamping anvil during bending of each apron half segment.

20. The apparatus of claim 19, wherein a cam plate is mounted on the bottom surface of the form bar and includes a camming edge in constant engagement with the inwardly extending channel in the stationary anvil.

21. The apparatus of claim 20, wherein the bending arrangement further includes a bend arm pivotally mounted to the stationary anvil.

22. The apparatus of claim 21, wherein the bend arm is a wishbone-shaped element having a first finger and a second finger spaced from the first finger, the distance between the fingers controlling the bending of each apron half segment.

23. The apparatus of claim 22, wherein an adjusting screw is threaded through the second finger to control the direction of wrinkling of the apron half segment during forming of the apron.

24. The apparatus of claim 18, wherein the clamping anvil is movable to position the lower band into conforming relationship with an interior portion of the C-shaped apron half segment such that the vertical wall of the apron half segment is clamped between the clamp block and the clamping anvil, and the lower horizontal wall of the apron half segment is clamped in the niche between the lower band of the clamping anvil and the upper lip of the stationary anvil.

25. The apparatus of claim 13, including an alignment arrangement for positioning each of the apron half segments along a longitudinal axis of the apparatus on a pair of apron support surfaces.

26. The apparatus of claim 25, wherein the alignment arrangement includes a push rod assembly engageable with one end of each apron half segment and a back gauge assembly engageable with the other end of the apron half segment.

27. The apparatus of claim 18, wherein each apron half segment has a male, tongued end which is received in a female end defined by the cooperating end of the other apron half segment.

28. A method of forming an apron adapted to be secured to the underside of a table from a pair of apron half segments, each having a pair of ends, the method comprising the steps of:

establishing a series of four apron support surfaces lying in a common plane;

providing a clamping arrangement on each of the apron support surfaces;

supplying a bending arrangement on each of the apron support surfaces;

positioning each of the apron half segments between the clamping arrangement and the bending arrangement on a pair of apron support surfaces such that the apron half segments lie substantially parallel to each other;

moving each of the bending arrangements into engagement with the apron half segments to bend the apron half segments such that the ends of one apron half segment are placed in overlapping relationship with the ends of the other apron half segment; and joining the overlapped ends of the bent apron half segments while the apron half segments remain positioned on the apron support surfaces.

29. An apron forming apparatus for bending and joining a pair of apron half segments, each having a pair of ends, the apparatus comprising:

a stationary framework having a longitudinal axis;

a movable frame slidably mounted on the stationary framework;

first and second apron support surfaces mounted on the stationary framework;

third and fourth apron support surfaces attached to the movable frame;

the first, second, third and fourth apron support surfaces lying in a common plane;

a clamping arrangement secured to each of the first, second, third and fourth apron support surfaces for selectively clamping an apron half segment wherein a bending arrangement positioned on each of the first, second, third and fourth apron support surfaces for selectively bending an apron half segment;

each of the bending arrangements is engageable with an apron half segment to bend the apron half segment such that the ends of one bent apron half segment are placed in overlapping relationship with the ends of the other bent apron half segment;

a first drive system mounted on the stationary framework for moving the third and fourth apron support surfaces along an X-axis lying parallel to the longitudinal axis of the stationary framework and in the common plane;

a second drive system mounted on the first and second apron support surface for moving the first and second apron support surfaces along a Y-axis lying perpendicularly to the X-axis and in the common plane;

a third drive system mounted on the third and fourth apron support surfaces for moving the third and fourth apron support surfaces along the Y-axis;

a first fastening system mounted on the stationary framework between the first and second apron support surfaces for fastening one pair of bent overlapping apron half segment ends; and a second fastening system mounted on the movable frame between the third and fourth apron support surfaces for fastening the other pair of bent overlapping apron half segment ends, the first and second fastening systems each being movable above and below the first, second, third and fourth apron support surfaces along a Z-axis lying perpendicular to the common plane.

30. The apron forming apparatus of claim 29, wherein the stationary framework includes a pair of parallel side tubes, each having a guide rail fixed thereon.

31. The apron forming apparatus of claim 30, wherein the movable frame includes a set of bearing brackets for matingly receiving each guide rail on the stationary framework.

32. The apron forming apparatus of claim 29, wherein the first drive system includes a first servo motor mounted on the stationary framework in the vicinity of the second fastening system, a main ball screw having one end connected to the first servo motor and another end being connected to the stationary framework beneath the first a and second apron support surfaces, and a ball nut secured on the movable frame in threaded engagement with the main ball screw.

33. The apron forming apparatus of claim 29, wherein the second drive system includes a second servo motor mounted beneath the first apron support surface, a first supplementary ball screw arrangement connected with the second servo motor between and beneath the first and second apron support surfaces, a first ball nut connected to a first support structure for the first apron support surface and a second ball nut connected to a second support structure for the second apron support surface, the first and second ball nuts being in threaded engagement with the first supplementary ball screw arrangement.

34. The apron forming apparatus of claim 29, wherein the third drive system includes a third servo motor mounted beneath the fourth apron support surface, a second supplementary ball screw arrangement connected with the third servo motor between and beneath the third and fourth apron support surfaces, a third ball nut connected to the third apron support surface, and a fourth ball nut connected to the fourth apron support surface, the third and fourth ball nuts being in threaded engagement with the second supplementary ball screw arrangement.

35. The apron forming apparatus of claim 29, wherein the first and second apron support surfaces are slidably mounted on a first set of guide rods extending across the stationary framework, and the third and fourth apron support surfaces are slidably mounted on a second set of guide rods extending across the movable frame.

36. The apron forming apparatus of claim 29, including an alignment arrangement for positioning one of the apron half segments on the first and third apron support surfaces and the other of the apron half segments on the second and fourth apron support surfaces.

37. The apron forming apparatus of claim 36, wherein the alignment arrangement includes a pair of push rod assemblies, one being mounted on an outer end of the third apron support surface and the other being mounted on the outer end of the fourth apron support surface, each of the push rod assemblies having a slidable push rod provided with a pusher face engageable with one end of an apron half segment and a hydraulic cylinder for selectively moving the pusher face against the segment end.

38. The apron forming apparatus of claim 37, wherein the alignment arrangement further includes a back gauge assembly mounted on an outer end of the stationary framework opposite the push rod assemblies, the back gauge assembly including a bracket joined to a vertical frame member on the stationary framework and having a horizontal mounting plate with an upstanding mounting wall, a U-shaped slide fixed on the horizontal mounting plate, a pair of spaced guide rails attached to the U-shaped slide, an L-shaped arm having a base plate provided with a set of brackets slidably mounted on the guide rails and having a ball nut depending therefrom, a ball screw having one end supported for rotation on the U-shaped slide and another end coupled for driving engagement with a fourth servo motor supported by the upstanding mounting wall, the ball screw being in threaded engagement with the ball nut, the L-shaped arm carrying a cross bar having a pair of apron engaging pads, each being engageable with the other end of the apron half segment.

39. The apron forming apparatus of claim 29, wherein each of the first and second apron support surfaces are respectively mounted on first and second U-shaped tabletop supports fixed on opposed sides of a stationary support post secured on the stationary framework, and each of the third and fourth apron support surfaces are respectively mounted on third and fourth tabletop supports mounted on opposite sides of a movable servo post joined to the movable frame.

40. The apron forming apparatus of claim 29, wherein the bending arrangements are engageable with the apron half segments to effect four separate 90° bends in the common plane to provide a rectangular table apron.

* * * * *

UNITED STATES PATENT AND TRADEMARK OFFICE

CERTIFICATE OF CORRECTION

PATENT NO. : 6,128,811
DATED : October 10, 2000
INVENTOR(S) : James D. Panzer et al.

It is certified that error appears in the above-identified patent and that said Letters Patent is hereby corrected as shown below:

Column 23, claim 8,
Line 42, delete "was" and substitute therefor -- bar --;

Column 24, claim 19,
Line 35, delete "an" and substitute therefor -- on --;

Column 25, claim 29,
Line 46, after "segment" delete "wherein" and substitute therefor -- ; --;
Line 49, after "segment" delete ";" and substitute therefor -- wherein --;
Line 50, before "each" delete new paragraph;

Column 26, claim 32,
Line 24, before "and" delete "a".

Signed and Sealed this

First Day of January, 2002

*Attest:*

*Attesting Officer*

JAMES E. ROGAN
*Director of the United States Patent and Trademark Office*